US011994346B2

(12) United States Patent
Wagner et al.

(10) Patent No.: US 11,994,346 B2
(45) Date of Patent: May 28, 2024

(54) HEAT EXCHANGER AND COOLING METHOD

(71) Applicant: Technische Universitat Dresden, Dresden (DE)

(72) Inventors: Andreas Wagner, Dresden (DE); Yixia Xu, Dresden (DE); Ullrich Hesse, Affalterbach (DE)

(73) Assignee: Technische Universitat Dresden (DE)

( * ) Notice: Subject to any disclaimer, the term of this patent is extended or adjusted under 35 U.S.C. 154(b) by 299 days.

(21) Appl. No.: 17/595,215

(22) PCT Filed: May 20, 2020

(86) PCT No.: PCT/EP2020/064085

§ 371 (c)(1),
(2) Date: Nov. 11, 2021

(87) PCT Pub. No.: WO2020/234358

PCT Pub. Date: Nov. 26, 2020

(65) Prior Publication Data

US 2022/0221227 A1 Jul. 14, 2022

(30) Foreign Application Priority Data

May 20, 2019 (DE) ..... 10 2019 113 327.0

(51) Int. Cl.
*F28D 1/053* (2006.01)
*F25B 1/10* (2006.01)
(Continued)

(52) U.S. Cl.
CPC ..... *F28D 1/05341* (2013.01); *F25B 9/008* (2013.01); *F25B 39/02* (2013.01);
(Continued)

(58) Field of Classification Search
CPC ..... F28D 1/05341; F28D 2021/0071; F25B 9/008; F25B 39/02; F25B 1/10;
(Continued)

(56) References Cited

U.S. PATENT DOCUMENTS 9,297,595 B2 * 3/2016 Said ..... F28F 9/0282
2008/0105420 A1 * 5/2008 Taras ..... F28D 1/05366 165/174

(Continued)

FOREIGN PATENT DOCUMENTS

CN 101275790 A 10/2008
CN 101443621 A 5/2009

(Continued)

*Primary Examiner* — Henry T Crenshaw
*Assistant Examiner* — Kamran Tavakoldavani
(74) *Attorney, Agent, or Firm* — BARNES & THORNBURG LLP; Jeffrey R. Stone

(57) ABSTRACT

According to various embodiments of the invention, a heat exchanger can have at least one duct for conveying a coolant, wherein the at least one duct has a first section and a second section, the first section being arranged in the at least one duct upstream relative to the second section, in relation to a flow direction of the coolant, the second section having a cross section area that is larger than a cross section area of the first section, such that a sublimation of the coolant in the second section is made possible.

12 Claims, 8 Drawing Sheets

(51) Int. Cl.

| | |
|---|---|
| ***F25B 9/00*** | (2006.01) |
| ***F25B 39/02*** | (2006.01) |
| ***F28D 21/00*** | (2006.01) |
| ***F28F 1/00*** | (2006.01) |
| ***F28F 9/02*** | (2006.01) |
| ***F28F 13/08*** | (2006.01) |

(52) U.S. Cl.
CPC ..... *F28F 1/006* (2013.01); *F28F 9/0282* (2013.01); *F28F 13/08* (2013.01); *F25B 1/10* (2013.01); *F25B 2309/061* (2013.01); *F25B 2400/02* (2013.01); *F25B 2400/13* (2013.01); *F25B 2400/23* (2013.01); *F25B 2500/18* (2013.01); *F28D 2021/0071* (2013.01)

(58) Field of Classification Search
CPC ..... F25B 2309/061; F25B 2400/02; F25B 2400/13; F25B 2400/23; F25B 2500/18; F28F 1/006; F28F 9/0282; F28F 13/08
See application file for complete search history.

(56) References Cited

U.S. PATENT DOCUMENTS

| | | | | |
|---|---|---|---|---|
| 2008/0245505 | A1 | 10/2008 | Yamaguchi et al. | |
| 2017/0241715 | A1* | 8/2017 | Ota ..... | F25B 39/00 |

FOREIGN PATENT DOCUMENTS

| | | | |
|---|---|---|---|
| CN | 201903225 | U | 7/2011 |
| DE | 102015111183 | A1 | 1/2017 |
| EP | 1388722 | A2 | 2/2004 |
| EP | 2498039 | A1 | 9/2012 |
| JP | 2004308972 | A | 11/2004 |
| WO | 2006/083442 | A2 | 8/2006 |
| WO | 2017/067543 | A1 | 4/2017 |

* cited by examiner

HEAT EXCHANGER AND COOLING METHOD

CROSS-CITING TO RELATED APPLICATIONS

This application is a national phase of PCT Application PCT/EP2020/064085 filed on May 20, 2020, which claims priority to German Application DE 10 2019 113 327.0, which was filed on May 20, 2019, the entire contexts of each of these are incorporated by reference herein in their entirety.

TECHNICAL FIELD

Various embodiments relate to a heat exchanger and a cooling method.

BACKGROUND

A fluorinated refrigerant (e.g. R14, R23, etc.) may be used in a refrigeration system to achieve a cooling temperature below −50° C. by evaporation of the refrigerant. Such fluorinated refrigerants pose a problem for environmental protection, for example due to their increased Global Warming Potential (GWP). Sublimation of carbon dioxide ($CO_2$) is an environmentally friendly alternative for cooling at low temperatures (e.g. at temperatures below −20° C., below −35° C., below −50° C., etc.) because $CO_2$ is a natural refrigerant with low GWP (e.g. the GWP of $CO_2$ is negligible compared to fluorinated refrigerants in low temperature applications), non-flammable, and non-toxic. It is, however, challenging to maintain appropriate operating conditions (e.g., pressure, temperature, etc.) within a refrigeration system to achieve a similar temperature level using sublimation of $CO_2$ as when using evaporation of a fluorinated refrigerant because the heat transfer for sublimation is less than for evaporation. Furthermore, the solid refrigerant to be sublimed (e.g. solid particles of refrigerant) may cause blockage of the refrigeration system.

DETAILED DESCRIPTION

Figure 1:
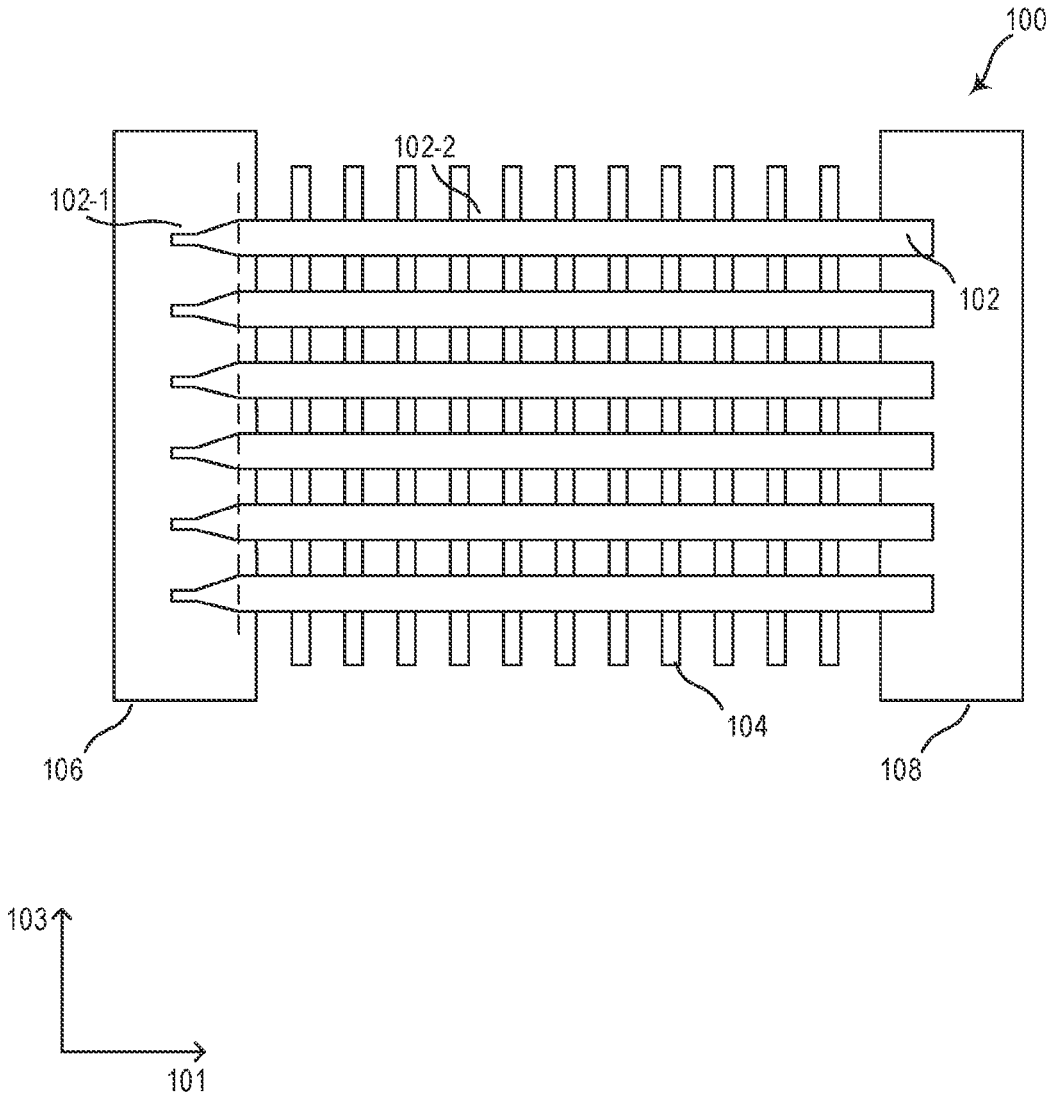
FIG. 1 shows a schematic diagram of a heat exchanger according to various embodiments.

Various embodiments relate to a heat exchanger. The application of the heat exchanger described herein in a refrigeration system (e.g. in a cooling system) allows for the refrigeration system to also be used in a sublimation-based cooling-process, and thus for cooling at a temperature level below −50° C.

According to various embodiments, a heat exchanger may comprise at least one duct/channel for carrying refrigerant, the at least one duct comprising a first section and a second section, the first section being disposed upstream relative to the second section with respect to a flow direction of the refrigerant in the at least one duct, the second section comprising a cross-sectional area that is greater than a cross-sectional area of the first section such that sublimation of the refrigerant in the second section is enabled.

In various aspects, the first section may serve to distribute and expand the refrigerant (e.g. the liquid refrigerant, for example above the triple point). In various aspects, the duct can be configured such that no heat transfer (from the refrigerant) occurs (or can occur) in the first section. In various aspects, the duct may be configured such that heat transfer (only first) occurs in the second section. The solid refrigerant is located in the second section (below triple point), where the heat transfer can take place. Illustratively, the duct may be configured such that the refrigerant is at different pressures and conditions in the two sections.

According to various embodiments, a cooling method for cooling a fluid using sublimation of a refrigerant may comprise: providing a refrigerant to a heat exchanger, the heat exchanger comprising at least one duct for carrying refrigerant; carrying the refrigerant into the at least one duct, the at least one duct comprising a first section and a second section, the first section being located upstream relative to the second section with respect to a direction of flow of the refrigerant in the at least one duct, the second section comprising a cross-sectional area that is greater than a cross-sectional area of the first section so as to allow sublimation of the refrigerant in the second section; providing heat transfer between the refrigerant flowing into the second section and the fluid to be cooled so that the refrigerant flowing into the second section can be sublimated and the fluid to be cooled is can in fact be cooled.

Examples of embodiments of the invention are shown in the figures and will be explained in more detail below.

In the following detailed description, reference is made to the accompanying drawings which form part thereof and in which are shown, by way of illustration, specific embodiments in which the invention may be practiced. In this regard, directional terminology such as "top", "bottom", "toward the front", "toward the rear", "front", "rear", etc. is used with reference to the orientation of the figure(s) described. As components of embodiments may be positioned in a number of different orientations, the directional terminology is for illustrative purposes and is not limiting in any way. It is understood that other embodiments may be used and structural or logical changes may be made without departing from the scope of protection of the present invention. It is understood that the features of the various exemplary embodiments described herein may be combined, unless specifically indicated otherwise. Therefore, the following detailed description is not to be construed in a limiting sense, and the scope of protection of the present invention is defined by the appended claims.

In the context of this description, the terms "connected", "attached" and "coupled" are used to describe both a direct and an indirect connection, a direct or indirect attachment, and a direct or indirect coupling. In the figures, identical or similar elements are given identical reference signs where appropriate.

In the context of this description, the term "at least one" is used for brevity, which can mean: one, exactly one, several (e.g., exactly two, or more than two), many (e.g., exactly three or more than three), etc. Here, the meaning of "several" does not necessarily mean that there are several identical elements, but rather essentially functionally identical elements.

In the context of this description, the term "duct" is used to describe both a duct formed by a single pipe (e.g., a single mini-duct) and a duct formed by a plurality of pipes (e.g., a plurality of mini-ducts). For example, a duct may be formed by a single pipe, and a plurality of ducts may be formed by a plurality of individual pipes arranged, for example, parallel to each other. For example, a duct may be formed through a plate, such as a flat metal plate (e.g., made of aluminum), in which a plurality of pipes (e.g., a plurality of mini-ducts) are formed, for example, by forming a plurality of openings along a length of the plate. For example, a plurality of plates may comprise a plurality of ducts, which may be arranged parallel to each other, and in each of which a plurality of pipes (e.g., a plurality of mini-ducts) are formed. A "duct" as used herein may also be referred to as a "channel". To the extent that a "channel" may be construed to represent only the space that is defined by a structure (e.g. a conduit or pipe, etc.), the term "duct" has been used to indicate both the space and the structure.

In the context of this description, the term "mini-duct" is used to describe a duct having a cross-section ranging from hundreds of micrometers to a few millimeters. For example, the cross-section of a mini-duct may have a size along a direction perpendicular to a flow direction of a fluid in the duct (e.g., a height, a width, a diameter, an edge length, etc.) that is in a range from about 100 μm to about 20 mm, for example, in a range from about 200 μm to about 15 mm, for example, in a range from about 500 μm to about 10 mm, for example, in a range from about 1 mm to about 5 mm, for example, in a range from about 100 μm to about 1.5 mm. These ranges may refer, for example, to a section of the duct in which heat transfer occurs between a fluid flowing in the duct (e.g., a refrigerant flowing in the duct) and another fluid (e.g., a fluid to be cooled). For example, a mini-duct may be formed by a plurality of pipes each having a cross-section in one of the areas described above.

As used herein, the term "upstream" is used to describe the relative location of one or more elements with respect to a direction of flow of a fluid (e.g., a refrigerant). For example, the term "upstream relative to an element" may describe a location disposed upstream of the element (e.g., upstream of an inlet of the element) such that the fluid flows first through that location and then into the element. For example, a first element may be disposed upstream relative to a second element such that the fluid flows first into the first element and then into the second element. It will be understood that the term "upstream" does not necessarily mean that the first element and the second element are disposed directly adjacent to each other, but other elements may be disposed between the first element and the second element along the direction of flow.

In this description, the term "downstream" is used to describe the relative location of one or more elements with respect to a direction of flow of a fluid (e.g., a refrigerant). For example, the term "downstream relative to an element" may describe a location disposed downstream of the element (e.g., downstream of an outlet of the element) such that the fluid flows first into the element and then through that location. For example, a first element may be located downstream relative to a second element such that the fluid flows first into the second element and then into the first element. It will be understood that the term "downstream" does not necessarily mean that the first element and the second element are disposed directly adjacent to each other, but other elements may be disposed between the first element and the second element along the direction of flow.

A conventional heat exchanger (e.g., a conventional evaporator) may have a plurality of parallel ducts (e.g., of parallel mini-ducts) for carrying and evaporating refrigerant. A conventional heat exchanger may also have a plurality of fins disposed between the ducts, increasing the surface area available for heat transfer. Such a heat transfer design (e.g. with fins) enables the provision of a compact heat exchanger, in which an efficient heat transfer between a fluid to be cooled and the refrigerant flowing (e.g. to be evaporated) into the ducts is ensured, due to the increased heat transfer area provided by the plurality of ducts.

Heat absorption in a heat exchanger by sublimation presents several challenges compared to evaporating refrigerant. Heat transfer is reduced and the accumulation of solid particles of refrigerant can lead to blockages and clogging of the heat exchanger.

A refrigeration system (e.g. a refrigeration plant) can generally be described as an open circuit or a closed circuit. In an open circuit, a refrigerant does not recirculate in the system after heat transfer with a fluid to be cooled, but the refrigerant is lost to the environment. In other words, after evaporation or sublimation, the refrigerant is no longer available. In contrast, in a closed loop system, the refrigerant remains in the system after heat transfer with the fluid to be cooled so that the refrigerant can be condensed and provided to the heat exchanger to repeat the process. Cooling by sublimation of a refrigerant (e.g. $CO_2$) is typically carried out in an open circuit, for example by spraying the refrigerant to be sublimed onto a surface to be cooled, so that large amounts of refrigerant should be used. Sublimation in a closed circuit is hindered, due to blockage (e.g., damage) of the components of the refrigeration system (e.g., the compressor) caused by the solid refrigerant to be sublimed (e.g., solid particles of refrigerant). One possibility could be to transport the solid refrigerant particles using a carrier fluid. However, in such an embodiment, additional energy would be required to circulate the carrier fluid. Further, the refrigerant should be separated from the carrier fluid after sublimation in order to be recompressed as part of the refrigeration cycle. Such a separation would require significant technical efforts and cause pressure losses, which can have a negative effect on the refrigerating capacity and the efficiency of the process.

A heat exchanger having multiple ducts (e.g. multiple mini-ducts) could be a suitable heat transfer method for sublimation. For example, the increased heat transfer surface due to the high number of ducts can compensate for the reduced heat transfer. If individual ducts are blocked, further ducts will remain for heat transfer, so that a refrigeration system in which the heat exchanger is used can continue to operate.

In the technical implementation, however, a problem arises in the distribution of the refrigerant to the various ducts. In a conventional refrigeration system, which is based on the evaporation of a refrigerant, an evaporator has a distributor, which consists of a kind of container into which the ducts (e.g. the mini-ducts) protrude. The refrigerant to be evaporated in the liquid and/or gaseous state of aggregation is distributed among the various ducts. A refrigerant to be sublimed (e.g. $CO_2$), which would enter the container in a solid and gaseous state, would block the duct entrances with its solid particles.

Therefore, there is a need for a solution that allows an efficient and cost-effective implementation of sublimation-based cooling in a closed circuit.

FIG. 1 illustrates a heat exchanger 100 in a schematic diagram according to various embodiments.

According to various embodiments, the heat exchanger 100 may include at least one duct 102 (e.g., at least one mini-duct) for carrying refrigerant. The heat exchanger 100 may be configured such that the refrigerant flowing into the at least one duct 102 may be in a heat transfer relationship with a fluid to be cooled (e.g., air, water, salt water, etc.) such that heat from the fluid to be cooled may be absorbed into the refrigerant flowing into the at least one duct 102. According to various embodiments, the at least one duct 102 may also include a plurality of pipes (e.g., a plurality of mini-ducts, a plurality of mini-duct pipes, etc.) for carrying refrigerant, which may be arranged parallel to each other, for example.

It will be understood that the heat exchanger 100 may also include a plurality of ducts 102 for carrying refrigerant, which may be arranged parallel to each other, for example.

According to various embodiments, the at least one duct 102 may include a first section 102-1 and a second section 102-2. The first section 102-1 may be arranged upstream relative to the second section 102-2 with respect to a direction of flow of the refrigerant in the at least one duct 102. In other words, the at least one duct 102 may be configured such that the refrigerant initially flows into the first section 102-1 and subsequently flows into the second section 102-2. According to various embodiments, the second section 102-2 may be arranged directly adjacent to the first section 102-1.

According to various embodiments, the second section 102-2 may have a cross-sectional area that is larger than a cross-sectional area of the first section 102-1 such that sublimation of the refrigerant in the second section 102-2 is enabled. For example, the heat exchanger 100 may be configured such that the refrigerant is in a heat transfer relationship with a fluid to be cooled when the refrigerant flows into the second section 102-2 so that heat may be absorbed from the fluid to be cooled into the refrigerant flowing into the second section 102-2. Illustratively, the heat exchanger 100 may be configured such that the refrigerant in the second section 102-2 may sublime, due to heat transfer with the fluid to be cooled.

In order for sublimation to take place, the refrigerant should be in an at least partially solid state of aggregation (e.g. in a solid/gaseous state of aggregation). Further, the refrigerant should be at such a temperature level and/or pressure level that a direct phase change from a solid state of aggregation to a gaseous state of aggregation is possible. In other words, the refrigerant should be at such a temperature level and/or pressure level which define a location in the phase diagram of the refrigerant where sublimation of the refrigerant is possible.

When a fluid (e.g., a refrigerant) flows into a restriction or choke (e.g., a choke opening, such as a section of a pipe having a reduced cross-sectional area), the velocity of the fluid increases and, as a result, the pressure of the fluid is reduced. Upstream of the choke, the fluid may be at a high pressure level (e.g., at a pressure level in a range from about 10 bars to about 160 bars, for example from about 70 bars to about 140 bars, for example from about 40 bars to about 70 bars). In the choke, the fluid reaches a critical (sonic) velocity (a so-called choked flow), so that the pressure in the choke drops to a lower pressure level (for example, to a pressure level in a range from about 10 bars to about 70 bars, for example from about 10 bars to about 40 bars, for example from about 40 bars to about 70 bars). Downstream relative to the restriction, further expansion of the fluid follows and the pressure of the fluid continues to drop (e.g., at a pressure level in a range from about 0 bars to about 5 bars).

It is understood that the pressure ranges described herein are chosen by way of example, and they may apply, for example, to $CO_2$ as the refrigerant to be sublimed. It is understood that the pressure ranges may be dependent on the refrigerant to be sublimed, and may be adjusted accordingly based on the refrigerant used.

According to various embodiments, the cross-sectional area of the first section 102-1 may be smaller than the cross-sectional area of the second section 102-2, such that the first section 102-1 provides a choke point at the inlet of the at least one duct 102. In other words, the first section 102-1 is a choke point at the inlet of the at least one duct 102.

According to various embodiments, the cross-sectional area of the first section 102-1 may be sized such that a refrigerant is at a high pressure level at a pressure level in a range from about, 10 bars to about 160 bars, for example, from about 70 bars to about 140 bars, for example, from about 40 bars to about 70 bars) upstream of the first section 102-1; in the first section 102-1, the refrigerant reaches a critical (sonic) velocity such that the pressure of the refrigerant in the first section 102-1 is at a lower pressure level (e.g., at a pressure level in a range from about 10 bars to about 70 bars, for example, from about 10 bars to about 40 bars, for example, from about 40 bars to about 70 bars); and after the first section 102-1 (in other words, downstream relative to the first section 102-1, upon entering the second section 102-2), further expansion of the refrigerant follows and the pressure of the refrigerant drops further, for example, to a sublimation pressure level (e.g., at a pressure level in a range from about 0 bars to about 5 bars). In other words, the cross-sectional area of the first section 102-1 may be sized such that a drop in pressure of a refrigerant flowing into the first section 102-1 occurs.

According to various embodiments, the cross-sectional area of the first section 102-1 may be sized such that the pressure of the refrigerant in the first section 102-1, illustratively up to the outlet of the first section 102-1, is above the sublimation pressure of the refrigerant such that the refrigerant in the first section 102-1 cannot sublimate. In other words, the cross-sectional area of the first section 102-1 may be sized such that the drop in pressure of the refrigerant flowing into the first section 102-1 is insufficient to allow sublimation of the refrigerant in the first section 102-1. Thus, the cross-sectional area of the first section 102-1 may be sized to prevent sublimation of the refrigerant in the first section 102-1. In other words, the heat exchanger may be configured (e.g., the first section may be sized) such that no heat transfer occurs between the refrigerant flowing into the first section and the fluid being cooled.

Undesirable effects may otherwise occur if the refrigerant instead exchanges heat with the fluid while flowing in the first section. For example, above the triple point of the refrigerant, evaporation of the liquid refrigerant may occur (heat gain at a higher temperature). As another example, below the triple point of the refrigerant, an additional component would be used to distribute the solid refrigerant into the first section (otherwise, blockage could occur upstream of the first section by solid refrigerant).

According to various embodiments, the cross-sectional area of the first section 102-1 may be sized such that the refrigerant in the first section 102-1 is at a pressure level that is greater than the pressure level of the triple point of the refrigerant.

According to various embodiments, the cross-sectional area of the first section 102-1 may be sized such that the refrigerant in the first section 102-1 is or may be in a non-solid (e.g., liquid, gas, liquid/gas, supercritical, etc.) state of matter. In other words, the cross-sectional area of the first section 102-1 may be sized such that the refrigerant is at such a pressure level that the refrigerant in the first section 102-1 is in a non-solid (e.g., liquid, gaseous, liquid/gas, supercritical, etc.) state of aggregation.

According to various embodiments, the cross-sectional area of the first section 102-1 may be dimensioned such that the critical mass flow rate through the restriction (in other words, through the first section 102-1), which depends on the inlet pressure and/or inlet temperature (e.g., the pressure and/or temperature at the inlet of the first section 102-1), is achieved and the critical outlet pressure (e.g., the pressure at the outlet of the first section 102-1) is above the triple point of the refrigerant. Thus, a blockage of the throttling point (e.g., a blockage of the first section 102-1, and thus of the at least one duct 102) can be prevented because the refrigerant in the throttling point (in other words, in the first section 102-1) is in a non-solid state of aggregation. Only after exiting the throttling point (in other words, upon entering the second section 102-2) does the refrigerant expand to sublimation pressure level.

According to various embodiments, the cross-sectional area of the first section 102-1 and the cross-sectional area of the second section 102-2 may be dimensioned such that the pressure of a refrigerant flowing into the at least one duct 102 downstream relative to the first section 102-1 (in other words, entering the second section 102-2) is lower (e.g., 5 bars lower, 10 bars lower, 20 bars lower, 30 bars lower, 50 bars lower, etc.) than the pressure in the first section 102-1. For example, the cross-sectional area of the first section 102-1 may be sized such that the refrigerant is at a pressure level in a range from about 10 bars to about 70 bars (e.g., from about 10 bars to about 40 bars, from about 40 bars to about 70 bars, etc.) in the first section 102-1. For example, the cross-sectional area of the second section 102-2 may be sized such that the refrigerant is at a pressure level in a range from about 0 bars to about 5 bars (e.g., at an atmospheric pressure level) in the second section 102-2.

According to various embodiments, the cross-sectional area of the first section 102-1 and the cross-sectional area of the second section 102-2 may be sized such that a refrigerant flowing into the at least one duct 102 is at such a pressure level downstream relative to the first section 102-1 (e.g., in the second section 102-2) as to allow sublimation of the refrigerant. For example, the cross-sectional area of the first section 102-1 and the cross-sectional area of the second section 102-2 may be sized such that the refrigerant is at a pressure level suitable for sublimation (e.g., at a sublimation pressure level, such as atmospheric pressure when the refrigerant comprises $CO_2$) as it flows into the second section 102-2.

The throttling of the refrigerant as it enters the at least one duct 102 ensures that the sublimation region of the refrigerant can first be reached in the at least one duct 102 (e.g., the second section 102-2), in other words, throttling the refrigerant as it enters the at least one duct 102 allows refrigerant in a non-sublimable (e.g., non-solid) state of aggregation to be provided to the at least one duct 102, and allows the refrigerant to transition to a sublimable (e.g., at least partially solid) state of aggregation only in the at least one duct 102.

According to various embodiments, the restriction may be dimensioned such that the refrigerant is expanded from the liquid or liquid/gas aggregate state upstream relative to the first section 102-1 to an at least partially solid (e.g., solid/gas) aggregate state downstream relative to the first section 102-1 (in other words, in the second section 102-2). For example, the cross-sectional area of the first section 102-1 and the cross-sectional area of the second section 102-2 may be sized such that a decrease in pressure occurs as the refrigerant flows from the first section 102-1 into the second section 102-2 such that the refrigerant transitions from a non-solid (e.g., liquid, gaseous, liquid/gas, supercritical, etc.) state of aggregation to art at least partially solid (e.g., solid/gas) state of aggregation. In other words, the cross-sectional area of the first section 102-1 and the cross-sectional area of the second section 102-2 may be sized to provide such a drop in pressure that the refrigerant reaches a sublimation region of the phase diagram of the refrigerant in the second section 102-2.

According to various embodiments, the first section 102-1 may have a cross-sectional area in a range from about 0.0001 $mm^2$ to about 0.8 $mm^2$, for example in a range from about 0.001 $mm^2$ to about 0.5 $mm^2$, for example in a range from about 0.005 $mm^2$ to about 0.25 $mm^2$. According to various embodiments, the second section 102-2 may have a cross-sectional area in a range from about 0.01 $mm^2$ to about 400 $mm^2$, for example in a range from about 0.1 $mm^2$ to about 100 $mm^2$, for example in a range from about 0.5 $mm^2$ to about 50 $mm^2$, for example in a range from about 1 $mm^2$ to about 20 $mm^2$.

Thus, the heat exchanger 100 can serve as a sublimator even if it is supplied with a non-solid (e.g., liquid, gas, liquid/gas, supercritical, etc.) refrigerant. For example, a conventional heat exchanger could be adapted using the configuration of the duct(s) described herein such that it could also be used for sublimation of refrigerant (e.g., $CO_2$). The arrangement described herein thus represents a comparatively low cost option for a sublimator which could be used in a closed refrigeration cycle.

The heat exchanger 100 may thus be configured to receive a refrigerant in a non-solid state of aggregation, and the refrigerant within the heat exchanger 100 changes to an at least partially solid state of aggregation, allowing sublimation of the refrigerant.

According to various embodiments, the refrigerant may comprise a natural refrigerant, such as carbon dioxide ($CO_2$). However, the refrigerant may also comprise a hydrocarbon-based refrigerant, such as HFC, HCFC, HFO, R170, R290, R600, etc. According to various embodiments, the refrigerant may comprise a mixture of a plurality of refrigerants that are different from each other. It will be understood that the refrigerant may be selected based on the desired operation of the heat exchanger 100 (e.g., the temperature range to be achieved).

According to various embodiments, the heat exchanger 100 may include at least one heat transfer element 104 disposed in contact (such as in direct physical contact) with the at least one duct 102. For example, the at least one heat transfer element 104 may be configured as one or more external protrusions from surfaces of the at least one duct 102 (such as a rib, a plurality of ribs, a fin, a plurality of fins, etc.). It is understood that the heat exchanger 100 may also include a plurality of heat transfer elements 104, which may be disposed in contact with the at least one duct 102 or between two adjacent ducts 102.

According to various embodiments, the at least one heat transfer element 104 may be configured to increase the surface area available for heat transfer between the fluid to be cooled and the refrigerant flowing into the at least one duct 102. (e.g., into the second section 102-2 of the at least one duct 102), such that the heat transfer rate and overall efficiency of the heat exchanger 100 may be improved. For example, the heat exchanger 100 may be configured to allow the fluid to be cooled to flow through the at least one heat transfer element 104 (e.g., in a direction at an angle to or perpendicular to the direction of flow of the refrigerant in the at least one duct 102) and to dissipate heat to the refrigerant in a more efficient manner.

According to various embodiments, the heat exchanger 100 may include a first container 106 (e.g., a distribution container). The first container 106 may be configured to supply the refrigerant to the at least one conduit 102. According to various embodiments, the first container 106 may be configured to distribute (e.g., evenly) the refrigerant to the plurality of pipes (e.g., to the plurality of mini-ducts) of the at least one duct 102 or to the ducts 102 of the plurality of ducts 102.

The arrangement described herein enables the refrigerant (e.g., to be sublimed) to be easily supplied or distributed using the first container 106 because the refrigerant is, or may be, in a non-solid (e.g., liquid, gaseous, liquid/gas, supercritical, etc.) state of aggregation when flowing into the first container 106. According to various embodiments, the first container 106 may be configured such that a refrigerant flowing into the first container 106 is in a non-solid (e.g., liquid, gaseous, liquid/gas, supercritical, etc.) state of aggregation. Thus, a refrigerant to be sublimed can also be supplied or distributed in a simple manner, and only change to an at least partially solid state of aggregation upon entering the at least one duct 102 (e.g., upon entering the second section 102-2).

According to various embodiments, the first container 106 may be configured such that the refrigerant is at a medium pressure level or a high pressure level (e.g., at a pressure level in a range from about 10 bars to about 160 bars, for example, from about 70 bars to about 140 bars, for example, from about 40 bars to about 70 bars, for example, from about 10 bars to about 40 bars, etc.) is located in the first container 106. Thus, the first container 106 may be configured such that the refrigerant is completely liquid or liquid/gaseous or supercritical in the first container 106. According to various embodiments, the first container 106 may be configured such that the refrigerant is at a pressure level in the first container 106 that is (e.g., always) above the pressure level of the triple point of the refrigerant. The throttling at a low pressure level (e.g., at a pressure level in a range of about 0 bars to about 5 bars) occurs in the second section 102-2 of the at least one duct 102.

According to various embodiments, the first container 106 may be configured as a separator (e.g., a medium pressure separator) for separating a liquid phase of the refrigerant from a gaseous phase of the refrigerant. In this embodiment, the first container 106 may be configured to supply the liquid refrigerant to the at least one duct 102, or to distribute the liquid refrigerant among the ducts of the plurality of ducts 102, and to discharge the gaseous refrigerant through an additional outlet (e.g., a gas outlet). As a result, the conditions (e.g., the pressure) of the refrigerant in the at least one duct 102 may be more accurately determined. Further, a liquid refrigerant can be supplied or distributed in a simpler manner.

According to various embodiments, the first container 106 may be adapted to be thermally insulated from a fluid to be cooled. For example, the first container 106 may comprise or be coated using a coating (e.g. thermal) that is adapted to thermally isolate the first container 106 from a fluid to be cooled that flows over or through the heat exchanger 100. As a result, subcooling of the refrigerant in the first container 106 may be prevented, such that the refrigerant in the first container 106 does not change to a sublimable (e.g. to an at least partially solid) state of aggregation.

According to various embodiments, the heat exchanger 100 may include a second container 108 (e.g., a collection container). The second container 108 may be configured to receive the refrigerant discharged from the at least one duct 102. According to various embodiments, the second container 108 may be configured to collect solid refrigerant components (e.g., solid particles of refrigerant). When the refrigerant changes to at least a partially solid state, solid refrigerant components of refrigerant may be formed. These solid refrigerant components may sublime in the second section 102-2 due to heat transfer with the fluid being cooled. In the event that some of these solid refrigerant components do not sublime, these some refrigerant components may be problematic for a refrigeration system. For example, these solid refrigerant components may cause damage to a compressor. Thus, the second container 108 may be configured such that solid refrigerant components discharged from the at least one duct 102 collect in the second container 108. Unwanted circulation of these refrigerant components in a refrigeration system may thus be prevented.

According to various embodiments, the second container 108 may be configured as a solids separator (e.g., a cyclonic separator). For example, the second container 108 may be configured to dispense gaseous refrigerant from a first outlet and to collect solid refrigerant (e.g., solid refrigerant components, such as solid particles of refrigerant). According to various embodiments, the second container 108 may include a second outlet for dispensing the accumulated solid refrigerant. In this manner, when the heat exchanger 100 is used in a refrigeration system, the second container 108 may allow only gaseous refrigerant to be provided for circulation into the refrigeration system.

FIG. 2A, FIG. 2B, FIG. 2C, FIG. 2D, FIG. 2E and FIG. 2F each illustrate a section of a duct 102 of a heat exchanger 100 in a schematic view according to various embodiments.

The first section 102-1 and the second section 102-2 of the at least one duct 102 may be or become arbitrarily sized and/or formed to achieve the effect of allowing sublimation of the refrigerant only in the second section 102-2. For example, the first section 102-1 and/or the second section 102-2 may have any shaped cross-section, such as a circular cross-section, an elliptical cross-section, a square cross-section, a rectangular cross-section, a polygonal cross-section, and so on.

According to various embodiments, the cross-section of the first section 102-1 may have the same shape as the cross-section of the second section 102-2. However, the cross-section of the first section 102-1 and the cross-section of the second section 102-2 may have a different shape from each other.

According to various embodiments, the first section 102-1 may have a cross-section that does not vary along a direction of flow of the refrigerant in the first section 102-1 (e.g., along a direction 101, such as a length of the first section 102-1). However, the first section 102-1 may also have a cross-section that varies along a flow direction of the refrigerant in the first section 102-1 (e.g., along a direction 101, such as a length of the first section 102-1). For example, a shape and/or a size of the cross-section of the first section 102-1 may change.

According to various embodiments, the second section 102-2 may have a cross-section that does not vary along a direction of flow of the refrigerant in the second section 102-2 (e.g., along a direction 101, such as a length of the second section 102-2). However, the second section 102-2 may also have a cross-section that changes along a flow direction of the refrigerant in the second section 102-2 (e.g., along a direction 101, for example, a length of the second section 102-2). For example, a shape and/or a size of the cross-section of the second section 102-2 may change.

Figure 2A:
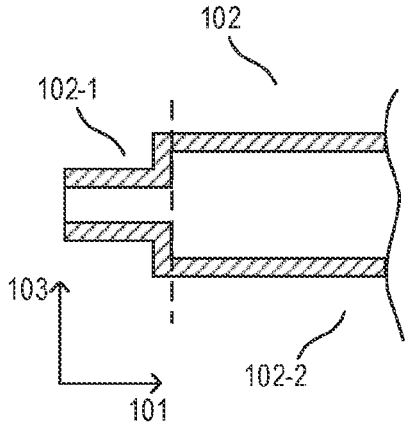
FIG. 2A, FIG. 2B, FIG. 2C, FIG. 2D, FIG. 2E and FIG. 2F each show a part of a duct of a heat exchanger in a schematic representation according to different embodiments.

According to various embodiments, the first section 102-1 and the second section 102-2 may be configured to provide a sudden (in other words, abrupt) change in cross-sectional area at the interface between the first section 102-1 and the second section 102-2, such as shown in FIG. 2A.

Figure 2B:
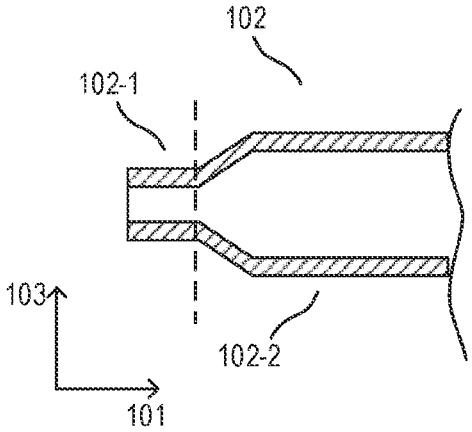

However, the second section 102-2 may also have a cross-sectional area that gradually increases from the interface with the first section 102-1 until a desired cross-sectional area is reached, such as shown in FIG. 2B. For example, the second section 102-2 may have a tapered shape. Thus, in this embodiment, there is a gradual change in cross-sectional area.

Thus, the shape and cross-sectional area of the first section 102-1 and the second section 102-2 may be selected as desired, for example depending on the refrigerant and/or other operating parameters of a refrigeration system in which the heat exchanger 100 is to be used.

According to various embodiments, the cross-section of the first section 102-1 may have a size along a direction perpendicular to the direction of flow of the refrigerant in the at least one duct 102 (e.g., perpendicular to a direction 101, such as a height, a width, a diameter, an edge length, etc.) which is in a range from about 0.01 mm to about 0.5 mm, for example in a range from about 0.01 mm to about 0.2 mm, for example in a range from about 0.02 mm to about 0.1 mm, for example in a range from about 0.02 mm to about 0.05 mm. For example, the cross-section of the first section 102-1 may have a size along a direction perpendicular to the direction of flow of the refrigerant in the at least one duct 102 that is less than 0.1 mm. For example, the cross-section of the first section 102-1 may be sized such that a refrigerant flowing into the first section 102-1 reaches a critical velocity (e.g., a sonic velocity).

According to various embodiments, the first section 102-1 may have a size along a direction parallel to the direction of flow of the refrigerant in the at least one duct 102. (e.g., along a direction 101, for example, a length of the first section 102-1) that is sized such that the refrigerant in the first section 102-1 remains in a non-solid state of aggregation. In other words, the length of the first section 102-1 may be dimensioned such that the drop in pressure of the refrigerant flowing into the first section 102-1 is insufficient to allow sublimation of the refrigerant in the first section 102-1 (e.g., to reach a pressure level below the triple point of the refrigerant).

According to various embodiments, the cross-section of the second section 102-2 may have a size along a direction perpendicular to the direction of flow of the refrigerant in the at least one duct 102 (e.g., perpendicular to a direction 101, such as a height, a width, a diameter, an edge length, etc.) that is in a range from about 0.1 mm to about 20 mm, for example from about 0.5 mm to about 10 mm, for example from about 1 min to about 5 mm.

According to various embodiments, the second section 102-2 may have a dimension along a direction parallel to the direction of flow of the refrigerant in the at least one duct 102 (e.g., along a direction 101, for example, a length of the second section 102-2) that is sized to allow complete sublimation of the refrigerant in the second section 102-2.

To obtain the desired dimensions of the cross-sectional area and cross-section of the first section 102-1, a wire of the desired size (e.g., of the desired diameter) may be inserted into a conventional duct (e.g., a conventional mini-duct); the initial section of the duct may then be clamped; and the wire may be finally removed so that, as a result, a duct 102 comprising a first section 102-1 with a reduced cross-sectional area is provided. The inserted wire may be coated, such that after clamping, the coating may be burned out by heating. This has the effect of providing a clearance between the duct 102 (e.g., between an inner surface of the duct 102) and the wire, so that the wire can be removed in a simpler manner. It will be understood that multiple wires may be used (e.g., simultaneously) to modify multiple ducts (e.g., multiple mini-ducts) or multiple pipes of a duct.

Alternatively, a duct may be clamped until the inlet of the duct is closed, and then a hole may be made (e.g., by drilling, by lasering, etc.) in the duct, so that as a result a duct 102 comprising a first section 102-1 with a reduced cross-sectional area may be provided. It is understood that multiple ducts (e.g., multiple mini-ducts) or multiple pipes of a duct may be modified simultaneously so that a hole may be made in the respective duct or pipe.

According to various embodiments, a narrowing element 210 (e.g., a sleeve, a perforated disc, a perforated plate, a cap, etc.) may be used to reduce the cross-sectional area of the first section 102-1 or provide a restriction point at the entrance of the at least one duct 102, as shown for example in FIG. 2C to 2F. The narrowing element 210 may be any suitable element, such that a choke point is provided at the entrance of the at least one duct 102.

The narrowing element 210 may have any suitable cross-section (e.g., an internal cross-section), such as a circular cross-section, an elliptical cross-section, a square cross-section, a rectangular cross-section, a polygonal cross-section, and so forth.

According to various embodiments, the cross-section (e.g., the internal cross-section) of the narrowing element 210 may have a size (e.g., an internal size) along a direction perpendicular to the direction of flow of the refrigerant in the narrowing element 210 (e.g., perpendicular to a direction 101, for example, a height, a width, a diameter, an edge length, etc.), which is in a range from about 0.01 mm to about 0.5 mm, for example in a range from about 0.01 mm to about 0.2 mm, for example in a range from about 0.02 mm to about 0.1 mm, for example in a range from about 0.02 mm to about 0.05 mm. For example, the cross-section of the narrowing element 210 may have a dimension along a direction perpendicular to the direction of flow of the refrigerant in the narrowing element 210 that is less than 0.1 mm. For example, the cross-section of the narrowing element 210 may be sized such that a refrigerant flowing into the narrowing element 210 reaches a critical velocity (e.g., a sonic velocity) in the narrowing element 210 (and illustratively, in the first section 102-1).

According to various embodiments, the cross-section (e.g., the internal cross-section) of the narrowing element 210 may be dimensioned such that sublimation of the refrigerant in the narrowing element 210 (and illustratively in the first section 102-1) is prevented. For example, the cross-section of the narrowing element 210 may be dimensioned such that the refrigerant is at a pressure level within the narrowing element 210 at which sublimation of the refrigerant is impossible. For example, the cross-section of the narrowing element 210 may be dimensioned such that the refrigerant in the narrowing element 210 is in a non-solid (e.g., liquid, gaseous, liquid/gas, supercritical) state of aggregation. According to various embodiments, the cross-section of the narrowing element 210 may be dimensioned such that the refrigerant is at a pressure level within the narrowing element 210 that is greater than the pressure level of the triple point of the refrigerant.

According to various embodiments, the narrowing element 210 may have a dimension along a direction parallel to the direction of flow of the refrigerant in the narrowing element 210 (e.g., along a direction 101, for example, a length of the narrowing element 210) that is sized such that the refrigerant in the narrowing element 210 remains in a non-solid aggregate state. In other words, the length of the narrowing element 210 may be dimensioned such that the drop in pressure of the refrigerant flowing into the narrowing element 210 is insufficient to allow sublimation of the refrigerant in the narrowing element 210 or to achieve a pressure level below the triple pressure of the refrigerant.

Figure 2C:
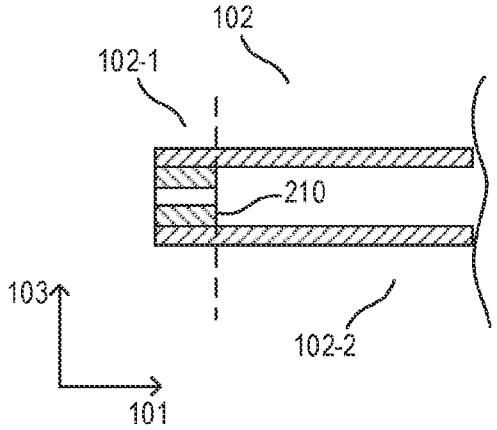
Figure 2D:
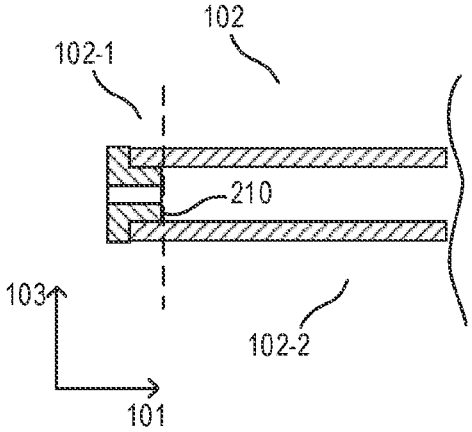

According to various embodiments, the at least one duct 102 may include a narrowing element 210 disposed in the first section 102-1 such that the cross-sectional area of the first section 102-1 may be reduced, as shown in FIG. 2C and FIG. 2D. For example, the narrowing element 210 may be inserted into a duct, and the duct (e.g., the inlet of the duct) may be clamped so that the narrowing element 210 is fixed, and as a result, a duct 102 comprising a first section 102-1 having a reduced cross-sectional area may be provided. It is understood that a narrowing element may be disposed in each duct of a plurality of ducts, or in each pipe (e.g., each mini-duct) of a duct.

According to various embodiments, the narrowing element 210 may be disposed entirely within the at least one duct 102 (e.g., within the first section 102-1), such as shown in FIG. 2C. However, the narrowing element 210 may also include a section that is disposed outside of the at least one duct 102 (e.g., outside of the first section 102-1), such as shown in FIG. 2D.

Figure 2E:
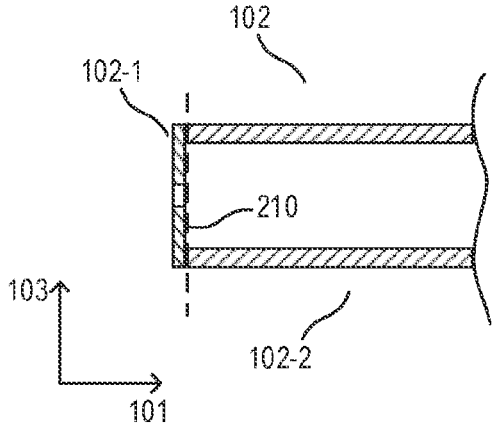
Figure 2F:
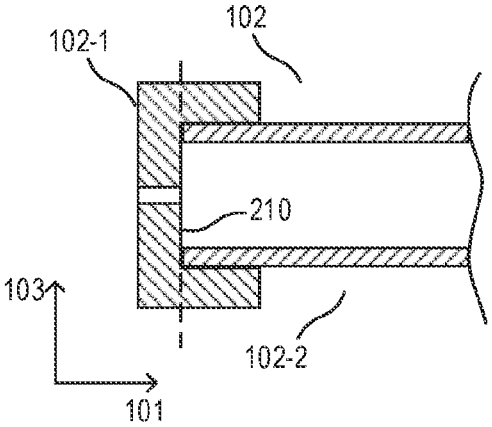

According to various embodiments, the narrowing element 210 may be disposed (e.g., attached, such as soldered, etc.) at the inlet of the at least one duct 102, as shown, for example, in FIG. 2E and FIG. 2F. In this embodiment, the narrowing element 210 may have a length or thickness in a range from about 1 micron to about 500 μm, for example in a range from about 50 μm to about. 200 μm.

For example, the narrowing element 210 may be a thin plate (e.g., a sheet, a disk) in which one or more holes are made, such as shown in FIG. 2E. Alternatively, the narrowing element 210 may be a cap arranged at the inlet of the at least one duct 102 and in which one or more holes are made, such as shown in FIG. 2F.

In this embodiment, the narrowing element 210 may form an additional section of the at least one duct 102. Thus, the narrowing element 210 may serve as a first section 102-1 of the at least one duct 102, and the at least one duct 102 may serve as a second section 102-2 of the at least one duct 102. In other words, the narrowing element 210 and the at least one duct 102 may be configured or dimensioned such that a refrigerant is located upstream of the narrowing element 210 at a high pressure level (e.g. at a pressure level in a range from about 10 bars to about 160 bars, for example in a range from about 70 bars to about 140 bars, for example in a range from about 40 bars to about 70 bars); in the narrowing element 210, the refrigerant reaches a critical (sonic) velocity such that the pressure of the refrigerant in the narrowing element 210 is at a lower pressure level (for example at a pressure level in a range from about 40 bars to about 70 bars). for example, at a pressure level in a range from about 10 bars to about 70 bars, for example, from about 10 bars to about 40 bars, for example, from about 40 bars to about 70 bars), and after the narrowing element 210 (for example, upon entering the at least one duct 102), further expansion of the refrigerant follows and the pressure of the refrigerant drops further, for example, at a sublimation pressure level (for example, at a pressure level in a range from about 0 bars to about 5 bars).

According to various embodiments, a heat exchanger 100 may include at least one duct 102 for carrying refrigerant, and at least one narrowing element 210 disposed upstream relative to the at least one duct 102, the at least one duct 102 comprising a cross-sectional area that is greater than a cross-sectional area (e.g., an internal cross-sectional area) of the at least one narrowing element 210 such that sublimation of the refrigerant in the at least one duct 102 is enabled.

Figure 2G:
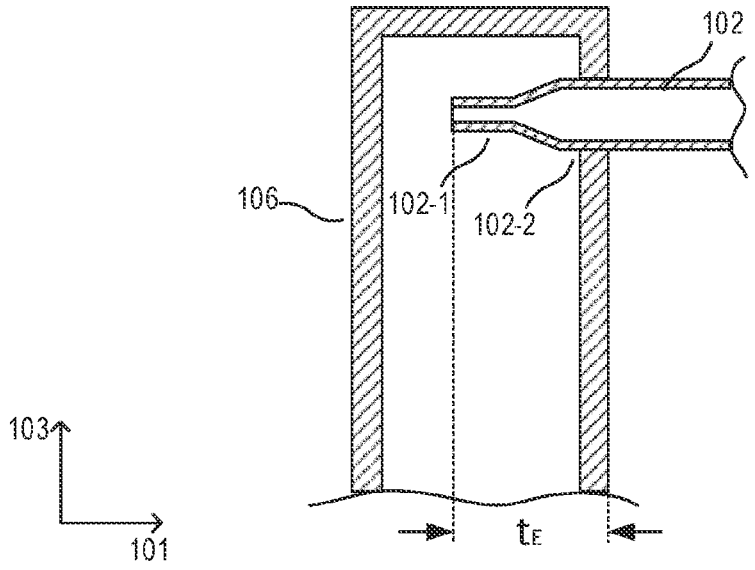
FIG. 2G shows a schematic representation of a container and a duct of a heat exchanger according to various embodiments.

FIG. 2G illustrates a vessel 106 and a duct 102 of a heat exchanger 100 in a schematic view according to various embodiments.

For clarity, only the first container 106 and the at least one duct 102 are shown in FIG. 2G. It will be understood that the other elements of the heat exchanger 100 (e.g., the second vessel 106, the at least one heat transfer element 104, etc.) are also present.

According to various embodiments, the at least one duct 102 may be inserted (e.g., by soldering) into the first container 106. When connecting the at least one duct 102 to the first container 106, care should be taken to ensure that the first section 102-1 is not deformed (e.g., due to thermal expansion) or sealed (e.g., due to solder) in the process.

For example, the at least one duct 102 may protrude into the first container 106 such that the first section 102-1 is sufficiently removed from the junction (e.g., solder joint) between the at least one duct 102 and the first container 106 such that undesirable modifications to the first section 102-1 (in other words, the restriction) may be avoided. According to various embodiments, the at least one duct 102 may be inserted into the first container 106 at such a depth $t_E$ that undesirable modifications of the first section 102-1 may be avoided.

If a narrowing element 210 is used to reduce the cross-sectional area of the first section 102-1 or to form an additional section of the at least one duct 102, the narrowing element 210 may comprise a material that is not wetted by the solder used.

Possible arrangements for a refrigeration system comprising the heat exchanger 100 described herein are described below. It is understood that the arrangements are chosen by way of example, and other arrangements and components suitable as desired are also possible.

Figure 3:
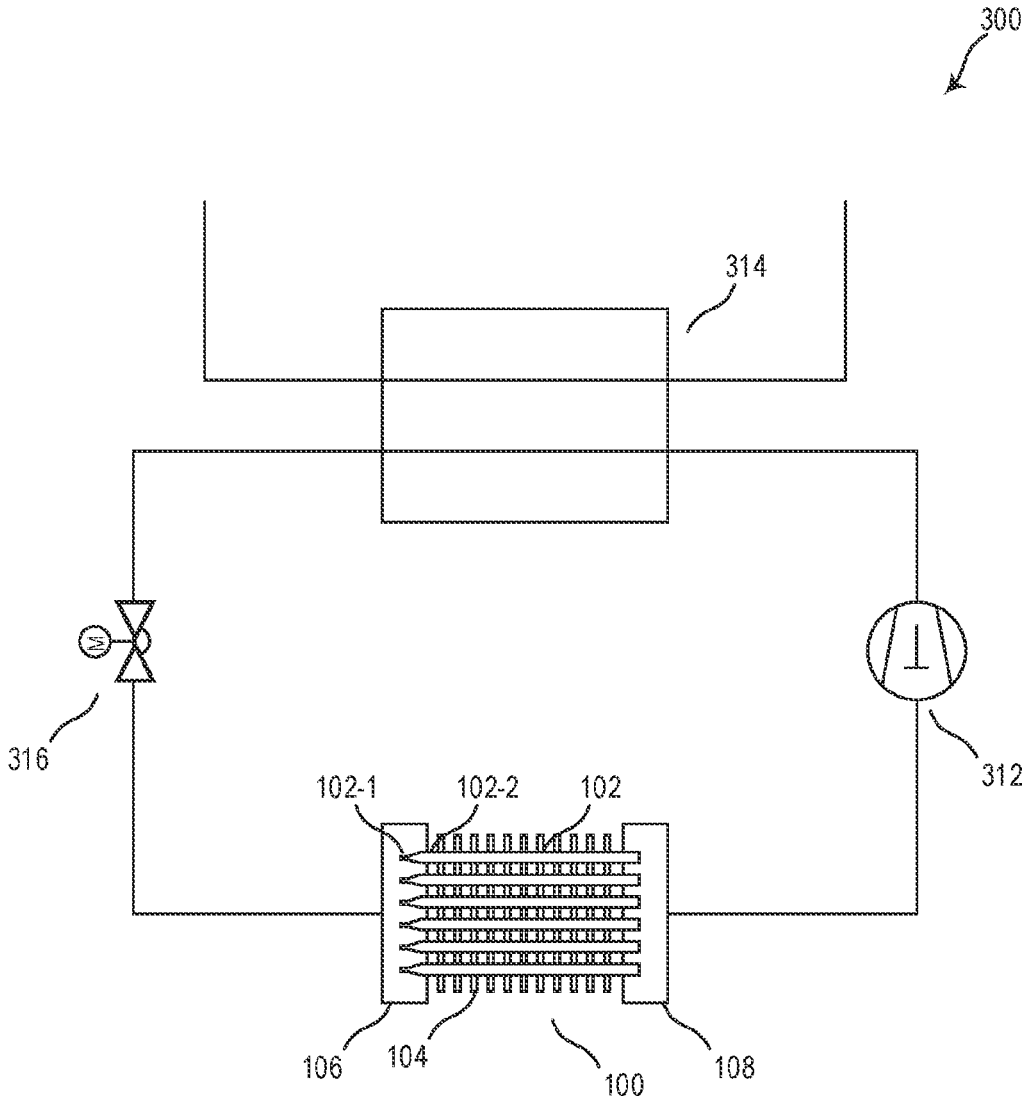
FIG. 3 shows a refrigeration system comprising a heat exchanger in a schematic representation according to various embodiments.

FIG. 3 illustrates a refrigeration system 300 comprising a heat exchanger 100 in a schematic view according to various embodiments.

According to various embodiments, the heat exchanger 100 may be or may become inserted into a refrigeration system 300 (e.g., a refrigeration system) such that the refrigeration system 300 may also be used for a sublimation-based cooling process, and thus for cooling at a temperature level below −50° C. The refrigeration system 300 may be a conventional (e.g., cold vapor-based) refrigeration system in which an evaporator has been replaced by the heat exchanger 100 described herein.

According to various embodiments, the refrigeration system 300 may include a compressor 312 (e.g., a reciprocating compressor, a screw compressor, a rotary compressor, a centrifugal compressor, a scroll compressor, etc.) disposed downstream relative to the heat exchanger 100. The refrigeration system 300 may be configured such that the refrigerant output from the heat exchanger 100, which is in a gaseous state after sublimation, is supplied to the compressor 312. For example, the compressor 312 may be in (e.g. fluidic) communication with the heat exchanger 100, e.g. the compressor 312 and the heat exchanger 100 may be or become connected to each other (e.g. using a conduit, such as a suction conduit). According to various embodiments, the compressor 312 may be configured to draw the refrigerant from the outlet of the heat exchanger 100 (e.g., from the second vessel 108, such as from a gas outlet of the second vessel 108).

According to various embodiments, the compressor 312 may be configured to compress the refrigerant. Thus, for example, the compressor 312 may be configured to receive the refrigerant at a low pressure (e.g., at a pressure level in a range from about 0 bars to about 5 bars), and to discharge the refrigerant at a high pressure (e.g., at a pressure level in a range from about 10 bars to about 160 bars, for example, from about 70 bars to about 140 bars, for example, from about 40 bars to about 70 bars).

The compressor 312 may further be configured to circulate the refrigerant into the refrigeration system 300, such that the refrigerant may circulate into the refrigeration system 300.

According to various embodiments, the refrigeration system 300 may include a heat-dissipating heat exchanger 314 (e.g., a condenser, a gas cooler, etc.) disposed downstream relative to the compressor 312. According to various embodiments, the refrigeration system 300 may be configured to supply the refrigerant compressed by the compressor 312 to the heat-discharging heat exchanger 314. For example, the heat-dispensing heat exchanger 314 may be in (e.g., fluidic) communication with the compressor 312, e.g., the heat-dispensing heat exchanger 314 and the compressor 312 may be or become connected to each other (e.g., using a conduit, such as a gas line).

According to various embodiments, the heat-dispensing heat exchanger 314 may be disposed upstream relative to the heat exchanger 100. Thus, the refrigeration system 300 may be configured such that the refrigerant discharged from the heat-discharging heat exchanger 314 is supplied to the heat exchanger 100 (e.g., the first vessel 106). For example, the heat-dispensing heat exchanger 314 may be in (e.g., fluidic) communication with the heat exchanger 100 (e.g., the first container 106), e.g., the heat-dispensing heat exchanger 314 and the heat exchanger 100 may be or become connected to each other (e.g., using a conduit, such as a fluid conduit).

According to various embodiments, the heat-dissipating heat exchanger 314 may be configured such that the refrigerant flows into the heat-dissipating heat exchanger 314 and the refrigerant is in a heat transfer relationship with a secondary fluid (e.g., air, water, salt water, etc.) such that heat is extracted from the refrigerant and absorbed in the secondary fluid as the refrigerant flows into the heat-dissipating heat exchanger 314. Thus, the refrigerant may be cooled. According to various embodiments, the refrigerant discharged from the heat-discharging heat exchanger 314 may be in a high pressure state (e.g., the pressure of the refrigerant may be in a range from about 10 bars to about 160 bars, for example, from about 70 bars to about 140 bars, for example, from about 40 bars to about 70 bars).

Alternatively or additionally, the heat-dispensing heat exchanger 314 may be configured such that the refrigerant flows into the heat-dispensing heat exchanger 314 and the latter is in a heat transfer relationship with a second refrigerant. For example, the heat-discharging heat exchanger 314 may be in a heat transfer relationship with another heat exchanger (e.g., another refrigeration circuit) so that heat may be extracted front the refrigerant flowing into the heat-discharging heat exchanger 314 and absorbed into the second refrigerant flowing into the other heat exchanger (e.g., the other refrigeration circuit).

The pressure of the refrigerant in the first reservoir 106 of the heat exchanger 100, and the pressure of the refrigerant at the inlet of the first section 102-1 of the at least one duct 102, affects the critical mass flow rate, which represents the maximum mass flow rate that can flow into the restriction (e.g., into the first section 102-1). For example, the critical mass flow increases as the inlet pressure increases (e.g., as the pressure of the refrigerant at the inlet of the first section 102-1 increases). Using an increased mass flow rate, an increased refrigeration capacity can be achieved.

According to various embodiments, the refrigeration system 300 may further comprise an open-loop control system or a closed-loop control system. The open-loop control system may be configured to open-loop control the components of the refrigeration system 300 and/or the closed-loop control system to closed-loop control the operating conditions of the components of the refrigeration system 300.

Controlling (closed-loop) the pressure (e.g., the high pressure) of the refrigerant discharged from the heat-discharging heat exchanger 314, and thus controlling the pressure of refrigerant supplied to the heat exchanger 100, may have the effect of controlling the mass flow rate in the first reservoir 106 and/or in the first section 102-1. Increasing the high pressure may increase the critical mass flow rate, thereby lowering the superheat of the refrigerant and/or increasing the refrigeration capacity. For example, controlling the high pressure may be accomplished by controlling the temperature level of the heat emitting heat exchanger 314.

According to various embodiments, the open-loop control system may be configured to open-loop control and/or the closed-loop control system may be configured to closed-loop control the heat-dispensing heat exchanger 314 such that the pressure of the refrigerant dispensed by the heat-dispensing heat exchanger 314 is increased (or decreased) such that the mass flow rate of the refrigerant in the first container 106 is increased (or decreased). For example, the open-loop control system may be configured to control (open-loop) and/or the closed-loop control system may be configured to control (closed-loop) the heat-dispensing heat exchanger 314 such that the pressure of the refrigerant dispensed by the heat-dispensing heat exchanger 314 is increased (and/or decreased) such that the mass flow is increased (and/or decreased) and/or the superheat of the refrigerant is decreased (and/or increased).

The refrigeration system 300 may optionally include a valve 316 (e.g., a throttle valve, a capillary pipe, an expansion valve, such as a thermostatic expansion valve, an electronic expansion valve, a manual expansion valve, etc.) that may be disposed downstream relative to the heat-emitting heat exchanger 314 and upstream relative to the heat exchanger 100 (e.g., between the heat-emitting heat exchanger 314 and the heat exchanger 100).

Using the valve 316, superheat and/or refrigeration capacity can be open-loop controlled or closed-loop controlled. However, two-phase (e.g., liquid/gaseous) refrigerant or supercritical refrigerant flows into the first reservoir 106. A liquid/gaseous entry condition into the first reservoir 106 results in a worse distribution than a pure liquid or supercritical entry condition.

According to various embodiments, the refrigeration system 300 may be configured such that the refrigerant discharged from the heat-discharging heat exchanger 314 is supplied to the valve 316. For example, the valve 316 may be in (e.g., fluidic) communication with the heat-dispensing heat exchanger 314, e.g., the valve 316 and the heat-dispensing heat exchanger 314 may be or become connected to each other (e.g., using a conduit, such as a gas conduit, a liquid conduit, etc.).

According to various embodiments, the refrigeration system 300 may be configured such that the refrigerant dispensed by the valve 316 is supplied to the heat exchanger 100. For example, the valve 316 may be in (e.g., fluidic) communication with the heat exchanger 100, e.g., the valve 316 and the heat exchanger 100 may be or become connected to each other (e.g., using a conduit, such as a gas conduit, a liquid conduit, etc.).

The valve 316 may be configured to reduce the pressure of the refrigerant as it flows into the valve 316, such that the valve 316 may be used to regulate the pressure of the refrigerant supplied to the heat exchanger 100. Illustratively, the valve 316 can thus be used to regulate the pressure of the refrigerant in the first reservoir 106 and in the first section 102-1. As a result, the mass flow rate and/or the refrigeration capacity in the heat exchanger 100 can be adjusted using the valve 316.

According to various embodiments, the open-loop control system may be configured to open-loop control or the closed-loop control system may be configured to closed-loop control the valve 316 such that the pressure of the refrigerant discharged from the valve 316 is increased (or decreased) such that the mass flow rate of the refrigerant in the heat exchanger 100 (e.g., in the first vessel 106) is increased (or decreased). In this embodiment, two expansion stages may be implemented. The first expansion stage is implemented using the valve 316, and the second expansion stage is located in the at least one duct 102 (e.g., after throttling provided by the first section 102-1).

According to various embodiments, the refrigeration system 300 may further comprise a shut-off valve (not shown) that may be disposed (e.g., directly) upstream relative to the heat exchanger 100. The shut-off valve may be configured such that, when closed, no refrigerant can flow into the shun-off valve, and that, when open, refrigerant can flow into the shut-off valve.

According to various embodiments, the shut-off valve may be configured to remain closed when a cooling process is started until a minimum suction pressure is reached using the compressor 312 (e.g. by a refrigerant suction of the compressor 312). The shut-off valve may thus be configured in such a way that it opens or is opened only after the minimum permissible suction pressure has been reached.

According to various embodiments, the shut-off valve may be configured to close during operation when a maximum allowable suction pressure is exceeded. Using the shut-off valve, therefore, the flow of refrigerant into the heat exchanger 100 may be suitably enabled (or prevented) when the pressure level in the refrigeration system 300 is suitable for the desired operation of the heat exchanger 100 (e.g., to achieve sublimation of the refrigerant in the second section 102-2 of the at least one duct 102 of the heat exchanger 100). Further, the shut-off valve may be configured to remain closed during a system shutdown to maintain the operating pressure levels.

As has been illustrated above, the second vessel 108 of the heat exchanger 100 may be or may become configured to act as a solids separator. Alternatively or additionally, the refrigeration system 300 may comprise a solids separator (not shown) which may be arranged downstream relative to the heat exchanger 100. According to various embodiments, the solids separator may be configured to receive the refrigerant discharged from the heat exchanger 100; provide the gaseous refrigerant to the compressor 312; and collect the solid refrigerant (e.g., solid refrigerant components, such as solid particles of refrigerant). In this manner, the compressor 312 may be protected from damage caused by solid refrigerant.

According to various embodiments, the refrigeration system 300 may further comprise a particulate filter (not shown) configured to trap non-refrigerant particulates. The particulate filter may be disposed in any suitable location in the refrigeration system 300, such that the non-refrigerant particulates circulating into the refrigeration system 300 may be blocked. This may prevent blockage of the restriction point (e.g., the at least one duct 102 and/or the first section 102-1 of the at least one duct 102) due to the non-refrigerant particles.

According to various embodiments, the refrigeration system 300 may include an internal heat exchanger (not shown) for transferring heat to the suction gas at the outlet of the heat exchanger 100. The heat may be removed from the cooling process, for example, downstream of the heat-releasing heat exchanger 314. In this embodiment, the efficiency of the process and the cooling capacity may be increased.

Figure 4:
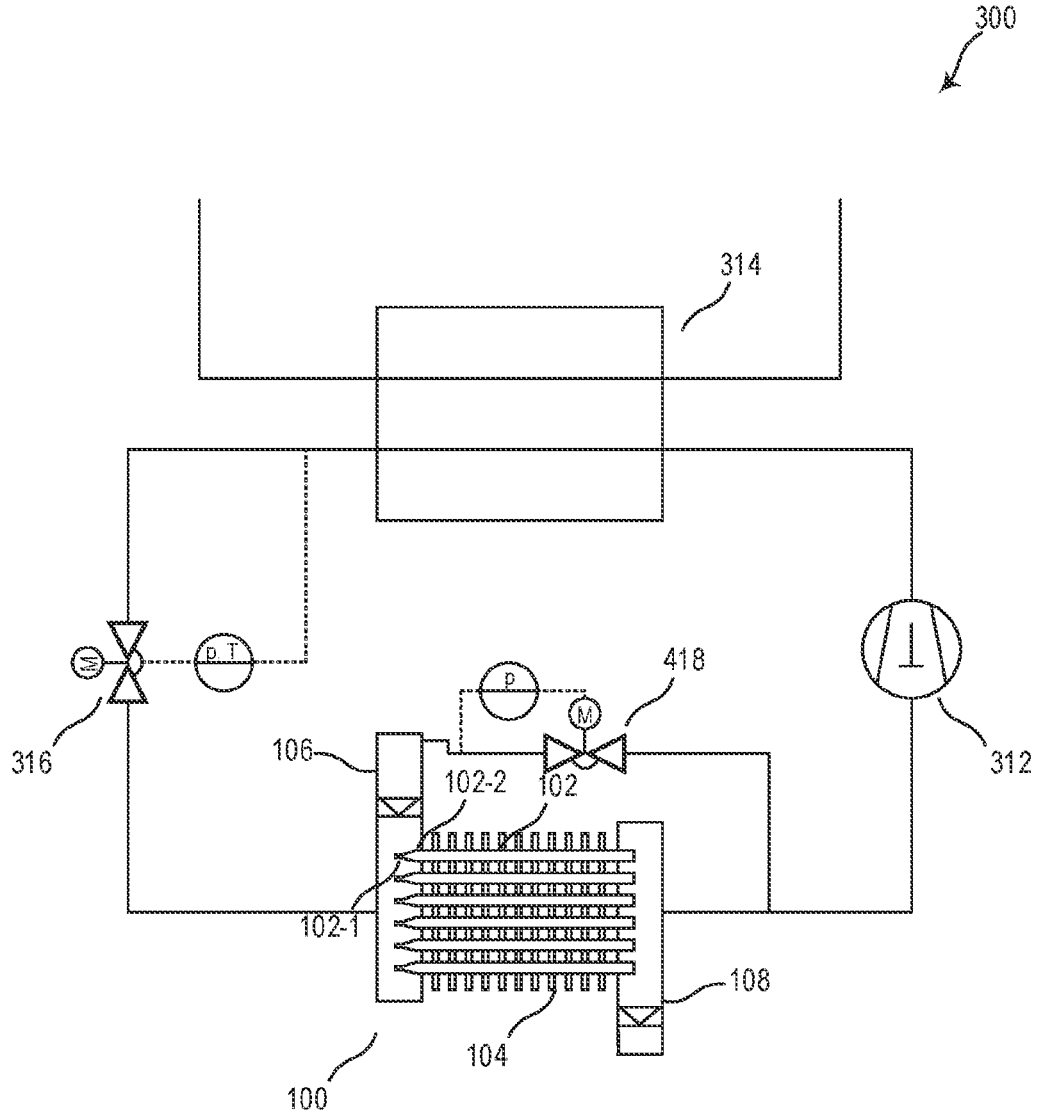
FIG. 4 shows a refrigeration system comprising a heat exchanger in a schematic representation according to various embodiments.

FIG. 4 illustrates a refrigeration system 300 comprising a heat exchanger 100 in a schematic view according to various embodiments.

As has been illustrated above, the first vessel 106 may be or may become configured as a separator (e.g., a medium pressure separator). In such an embodiment, the first vessel 106 may include an elevation above the uppermost duct 102 (e.g., above the at least one duct 102 or above the uppermost duct 102 of the plurality of ducts 102). For example, the first container 106 may extend above the uppermost duct 102.

According to various embodiments, the first container 106 may include a gas outlet, which may be disposed, for example, in the elevation, and the refrigeration system 300 may be configured such that the gaseous refrigerant discharged from the gas outlet of the first container 106 is supplied to the compressor 312. For example, the refrigeration system 300 may be configured such that the gaseous refrigerant discharged from the gas outlet of the first container 106 is supplied to the compressor 312 together with the gaseous refrigerant discharged from the heat exchanger 100 (e.g., from the second container 108).

According to various embodiments, the refrigeration system 300 may optionally include an additional valve 418 (e.g., a throttle valve, a capillary pipe, an expansion valve, such as a thermostatic expansion valve, an electronic expansion valve, a manual expansion valve, etc.), which may be configured to reduce the pressure of the refrigerant as it flows into the additional valve 418, and which may be arranged downstream relative to the gas outlet of the first container 106 (e.g., between the gas outlet of the first container 106 and the compressor 312). The additional valve 418 may be in (e.g. fluidic) communication with the gas outlet of the first container 106, for example, the additional valve 418 and the gas outlet of the first container 106 may be or may become connected together (e.g. using a conduit, such as a gas line).

Thus, the additional valve 418 may be used to reduce the pressure of the gaseous refrigerant received from the gas output of the first container 106 so that it is at the same or similar pressure level as the gaseous refrigerant output from the heat exchanger 100 (e.g., from the second container 108). For example, the additional valve 418 may be configured to receive the refrigerant from the gas outlet of the first container 106 at a medium pressure level (e.g., at a pressure level in a range from about 10 bars to about 70 bars, for example, in a range from about 10 bars to about 40 bars, for example, in a range from about 40 bars to about 70 bars), and to reduce the pressure of the refrigerant to a low pressure level (e.g., at a pressure level in a range from about 0 bars to about 5 bars). Thus, the resulting intermediate pressure gas can be supplied to the suction gas of the compressor 312 via the additional valve 418.

Alternatively or additionally, the compressor 312 may be configured to supply gaseous refrigerant at an intermediate pressure level (e.g., at a pressure level in a range from about 10 bars to about 70 bars, for example in a range from about 10 bars to about 40 bars, for example in a range from about 40 bars to about 70 bars) within the compression process (a so-called intermediate injection). In this embodiment, the compressor 312 may be configured to receive refrigerant from the gas outlet of the first container 106 (e.g., directly) without reducing the pressure of the refrigerant. For example, the compressor 312 may have a first input and a second input, wherein the compressor 312 is configured to receive (in other words, draw in) refrigerant from the second container 108 through the first input, and to receive refrigerant from the gas output of the first container 106 through the second input. The refrigerant received from the gas outlet of the first container 106 may thus be supplied within the compression process, for example after the refrigerant received from the second container 108 is compressed.

As illustrated above, the second vessel 108 may be configured as a solids separator (e.g., a cyclonic separator). According to various embodiments, the second vessel 108 of the heat exchanger 100 may include an extension below the lowermost duct 102 (e.g., below the at least one duct 102 or below the lowermost duct 102 of the plurality of ducts 102). For example, the second container 108 may extend below the lowermost duct 102. According to various embodiments, the second container 108 may be configured to dispense gaseous refrigerant from a gas outlet, and to accumulate solid refrigerant (e.g., solid refrigerant components, such as solid particles of refrigerant). For example, the second container 108 may be configured to accumulate the solid refrigerant in the extension.

According to various embodiments, the refrigeration system 300 may be configured such that the gaseous refrigerant discharged from the second container 108 is supplied to the compressor 312. Thus, the suction of solid refrigerant by the compressor 312 can be avoided.

Alternatively or additionally, the second container 108 may include a second outlet through which solid refrigerant components (e.g., solid particles of refrigerant) may be dispensed and provided to the compressor 312. For example, the extension of the second container 108 and the compressor 312 may be in (e.g., fluidic) communication with each other. In this embodiment, the second container 108 may be configured such that the solid refrigerant components provided to the compressor 312 are sized such that they may sublime in transit to the compressor 312 and thus not cause damage to the compressor 312, Thus, it may be possible for refrigerator oil that is discharged from the compressor 312 and accumulates in the second container 108 (e.g., in the extension of the second container 108) after circulation in the circuit to be returned to the compressor 312.

To control superheating of the refrigerant, the superheating may be sensed at the bottom of the second vessel 108 (e.g., at the bottom of the solids separator). There, superheating only occurs when no solid refrigerant components leave the at least one duct 102 (or ducts 102 of the plurality of ducts 102). When superheat is measured elsewhere in or downstream of the second vessel 108 (e.g., in or downstream of the solids separator), superheat may be detected even though solid refrigerant is leaving the at least one duct 102 because the refrigerant is not in thermal equilibrium.

Figure 5:
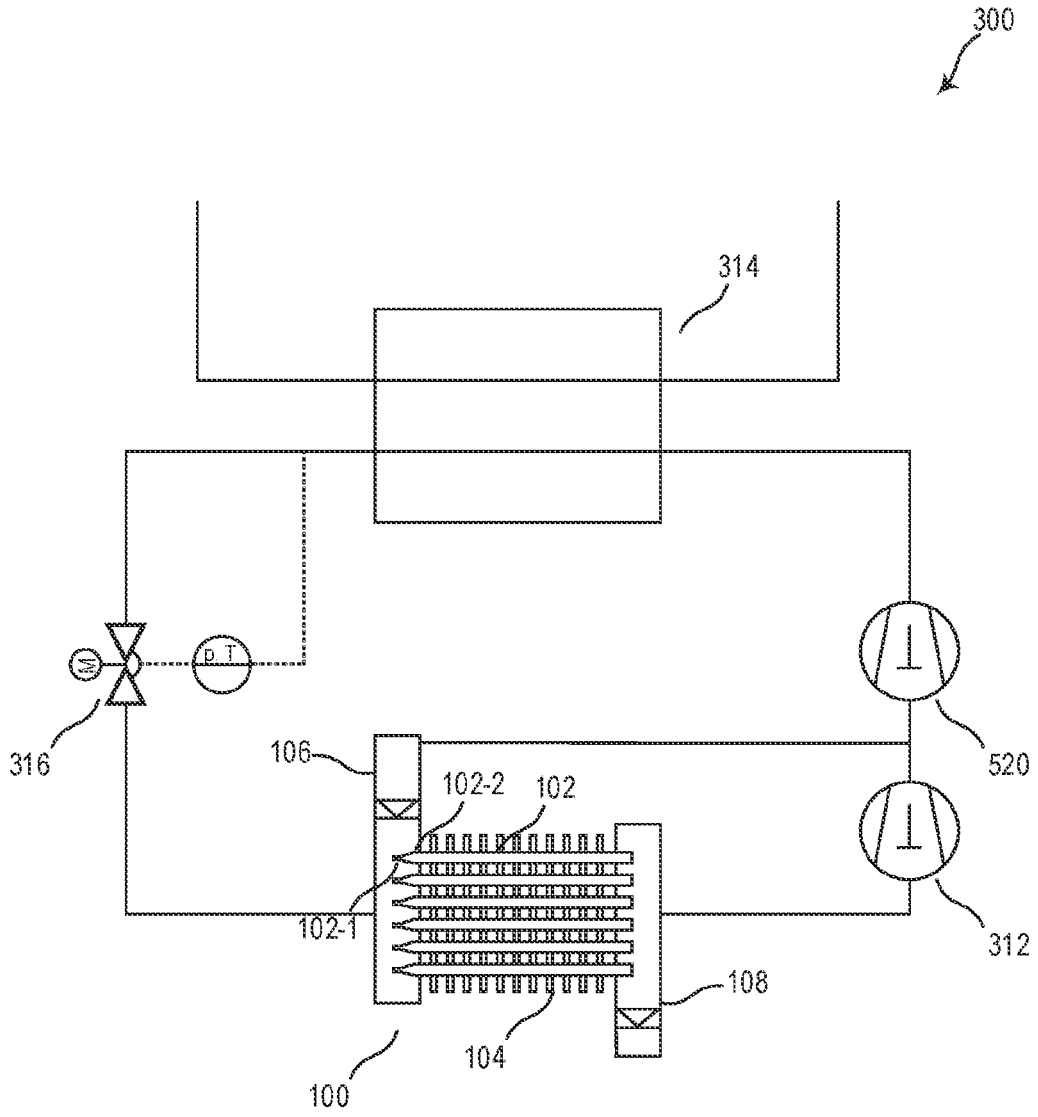
FIG. 5 shows a refrigeration system comprising a heat exchanger in a schematic representation according to various embodiments.

FIG. 5 illustrates a refrigeration system 300 comprising a heat exchanger 100 in a schematic view according to various embodiments.

According to various embodiments, the refrigeration system 300 may include a second compressor 520 (e.g., a reciprocating compressor, a screw compressor, a rotary compressor, a centrifugal compressor, a scroll compressor, etc.) such that two-stage compression of the refrigerant may be implemented. For example, the second compressor 520 may be located downstream relative to the first compressor 312.

In such an embodiment, the heat-dissipating heat exchanger 314 may be at an ambient temperature levels, resulting in high pressure ratios and compression end temperatures. The second compressor 520 may thus be used to achieve such high pressure ratios.

In this embodiment, the additional valve 418 may be omitted, and the gaseous refrigerant discharged from the first container 106 (e.g., from the gas outlet of the first container 106) may be supplied directly) to the second compressor 520. The two-stage compression allows for the pressure of the gaseous refrigerant that is discharged from the first container 106 (e.g., from the gas outlet of the first container 106) to not be reduced to a low pressure level. As a result, a higher efficiency of the process (e.g., the compression process) can be achieved.

According to various embodiments, the refrigeration system 300 may be configured such that the gaseous refrigerant discharged from the first container 106 (e.g., from the gas outlet of the first container 106) is supplied to the second compressor 520 along with the compressed refrigerant discharged from the compressor 312. For example, the gas outlet of the first container 106 and the second compressor 520 may be in communication with each other, e.g., the gas outlet of the first container 106 and the second compressor 520 may be or become connected to each other (e.g., using a conduit, such as a gas line). According to various embodiments, the second compressor 520 may be configured to draw refrigerant from the first container 106 (e.g., from the gas outlet of the first container 106).

According to various embodiments, the open-loop control system may be configured to open-loop control or the closed-loop control system may be configured to closed-loop control the second compressor 520 (e.g., a speed of the second compressor 520). For example, an increase in the speed of the second compressor 520 may result in a reduction in the pressure (e.g., the mean pressure) in the first vessel 106. In other words, the open-loop control system may be configured to open-loop control and/or the closed-loop control system may be configured to closed-loop control the second compressor 520 (e.g., the speed of the second compressor 520) such that the pressure of the refrigerant in the first container 106 may be increased (and/or decreased). Thus, the open-loop control or the closed-loop control of the second compressor 520 may also be used to control the superheating of the refrigerant.

Figure 6:
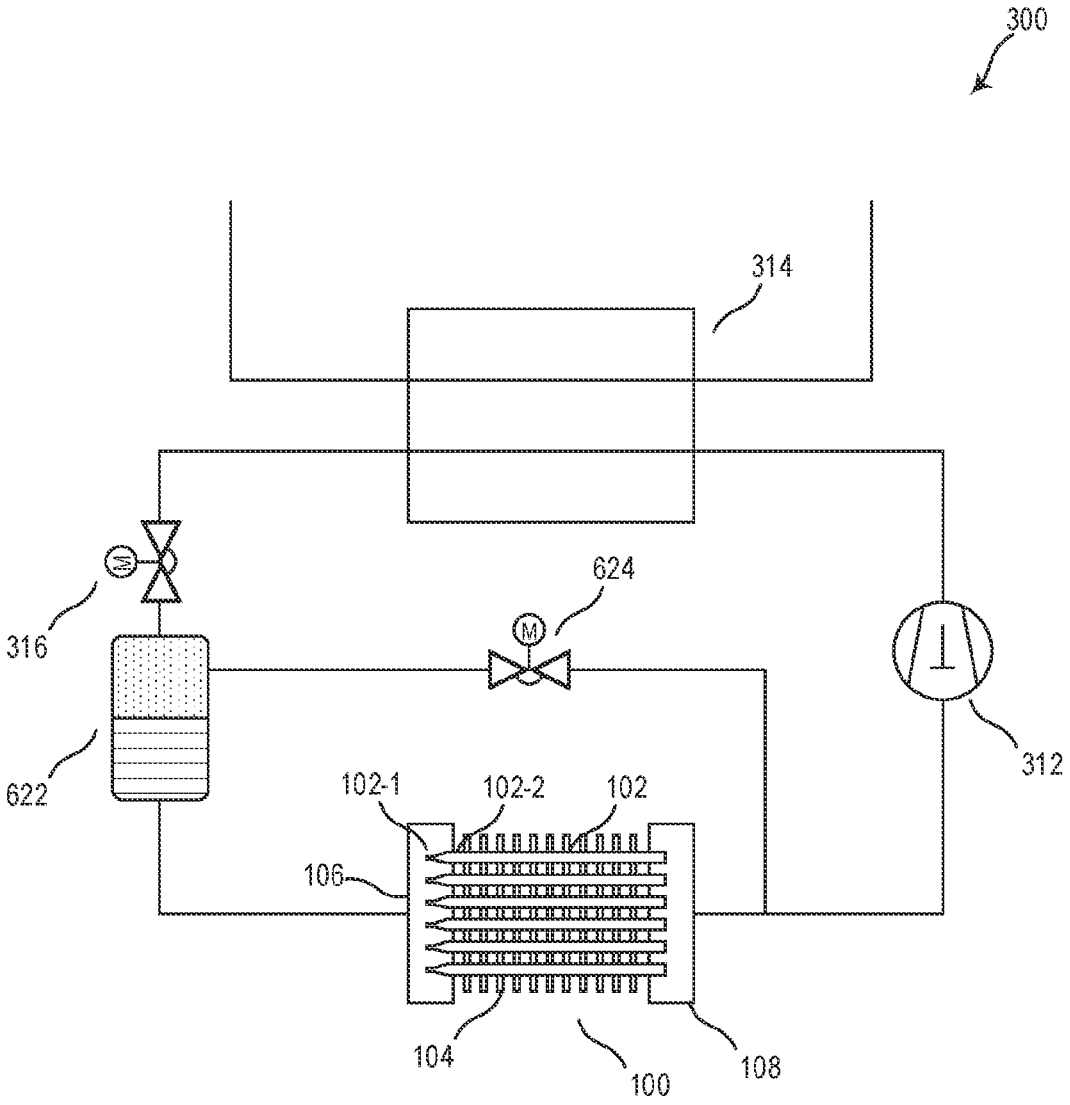
FIG. 6 shows a refrigeration system comprising a heat exchanger in a schematic representation according to various embodiments.

FIG. 6 illustrates a refrigeration system 300 comprising a heat exchanger 100 in a schematic view according to various embodiments.

According to various embodiments, the refrigeration system 300 may include a separator 622 (e.g., a medium pressure separator), which may be located upstream relative to the heat exchanger 100. The separator 622 may be configured to separate gaseous refrigerant from liquid refrigerant.

According to various embodiments, the refrigeration system 300 may be configured such that the liquid refrigerant output from the separator 622 is supplied to the heat exchanger 100. For example, the separator 622 may include a gas outlet and a liquid outlet, and the liquid outlet may be or may become connected to the heat exchanger 100 (e.g., to the first vessel 106). Thus, only liquid or supercritical refrigerant may be supplied to the first container 106. Using the separator 622 and the associated liquid or supercritical inlet in the first container 106, the refrigerant may be supplied or distributed in a more efficient manner.

According to various embodiments, the refrigeration system 300 may be configured such that the gaseous refrigerant discharged from the separator 622 is supplied to the compressor 312.

According to various embodiments, the refrigeration system 300 may include another valve 624 (e.g., a throttle valve, a capillary pipe, an expansion valve such as a thermostatic expansion valve, an electronic expansion valve, a manual expansion valve, etc.) that may be configured to reduce the pressure of the refrigerant as it flows into the other valve 624, and which may be arranged downstream relative to the gas outlet of the separator 622 and upstream relative to the compressor 312. The other valve 624 may be in (e.g. fluidic) communication with the gas outlet of the separator 622, for example the other valve 624 and the gas outlet of the separator 622 may be or may become connected together (e.g. using a conduit such as a gas line).

Thus, the other valve 624 may be used to reduce the pressure of the refrigerant discharged from the gas outlet of the separator 622 so that it is at the same or similar pressure level as the gaseous refrigerant discharged from the heat exchanger 100 (e.g., from the second vessel 108). For example, the other valve 624 may be configured to receive the refrigerant from the gas outlet of the separator 622 at a medium pressure level (e.g., at a pressure level in a range from about 10 bars to about 70 bars, for example, in a range from about 10 bars to about 40 bars, for example, in a range from about 40 bars to about 70 bars), and to reduce the pressure of the refrigerant to a low pressure level (e.g., at a pressure level in a range from about 0 bars to about 5 bars). Thus, the resulting medium pressure gas can be supplied to the suction gas of the compressor 312 via the other valve 624.

It will be understood that other elements may also be provided in the refrigeration system 300. For example, temperature sensors and/or pressure sensors may be provided to sense the temperature and/or pressure of the refrigerant in various sections of the refrigeration circuit. The sensed temperature and/or pressure may be used as feedback parameters to open-loop control or closed-loop control the operating parameters of the elements of the refrigeration system 300 (e.g., the operating parameters of the valve 316, the other valve 624, the compressor 312, etc.).

According to various embodiments, the open-loop control system may be configured to open-loop control or the closed-loop control system may be configured to closed-loop control the valve 316 and/or the other valve 624 based on the sensed temperature and or the sensed pressure. According to various embodiments, the open-loop control system may be configured to open-loop control and/or the closed-loop control system may be configured to closed-loop control the compressor 312 (e.g., a speed of the compressor 312) or the second compressor 520 (e.g., a speed of the second compressor 520) based on the sensed temperature and or on the sensed pressure.

For example, the valve 316 may be open-loop controlled or closed-loop controlled for subcritical operation according to a predetermined subcooling. When the resulting inlet pressure reaches a maximum predetermined subcritical high pressure, the valve 316 should be closed-loop controlled according to the predetermined maximum predetermined subcritical high pressure.

The other valve 624 may closed-loop control the pressure (e.g., the mean pressure) in the separator 622. Increasing the pressure (e.g., the mean pressure) results in increased critical mass flow, and thus increased cooling capacity and reduced superheating. For example, the open-loop control system may be configured to open-loop control or the closed-loop control system may be configured to closed-loop control the other valve 624 such that the pressure of the refrigerant discharged from the other valve 624 is increased (or decreased) such that the pressure of the refrigerant in the separator 622 is increased (or decreased). For example, the open-loop control system may be configured to open-loop control or the closed-loop control system may be configured to closed-loop control the other valve 624 such that the pressure of the refrigerant discharged from the other valve 624 is increased (or decreased) such that the mass flow rate of the refrigerant in the separator 622 is increased (or decreased).

The maximum pressure (e.g., the maximum mean pressure) is limited by a target high pressure upstream of the valve 316. The minimum pressure (e.g., the minimum intermediate pressure) is limited by the minimum critical pressure dependent thereon, which should be above the triple pressure of the refrigerant. Within this pressure range, the other valve 624 may also be open-loop controlled or closed-loop controlled according to refrigeration capacity or superheat. For example, during transcritical operation, the pressure (e.g., the intermediate pressure) may be maintained at subcritical pressure levels using the other valve 624.

Control of superheat can be accomplished by varying the volumetric flow rate of the compressor 312. For example, increasing the flow rate of the compressor 312 decreases the sublimation pressure and increases the superheat. The refrigeration capacity is only slightly increased by the amount of additional superheat. Limitations are imposed by the maximum sublimation pressure and the minimum allowable suction pressure. In other words, the open-loop control system may be configured to open-loop control and/or the closed-loop control system may be configured to closed-loop control the compressor 312 (e.g. the speed of the compressor 312) such that the pressure of the refrigerant (e.g. in the heat exchanger 100) may be increased (and/or decreased). Thus, using open-loop control or closed-loop control of the compressor 312. (e.g. the speed of the compressor 312), the superheating of the refrigerant can also be regulated.

In one embodiment, the open-loop control system may be configured to open-loop control or the closed-loop control system may be configured to closed-loop control the other valve 624 such that the pressure (e.g., the intermediate pressure) in the separator 622 is increased to supercritical pressure below or equal to the high pressure (e.g. at a pressure level in a range of about 10 bars to about 160 bars, for example in a range of about 70 bars to about 140 bars, for example in a range of about 40 bars to about 70 bars) such that supercritical refrigerant is provided to the heat exchanger 100 (e.g., the restriction provided by the first section 102-1) and expands in the second section 102-2 of the at least one duct 102 of the heat exchanger 100. Such expansion of the medium pressure range to include the supercritical pressure range may increase the range of power control by increasing the critical mass flow rate in the restriction (e.g., in the first section 102-1).

As described above, the refrigeration system 300 may include an internal heat exchanger. According to various embodiments, the internal heat exchanger may be located downstream relative to the liquid outlet of the separator 622 so as to allow sub-cooling of the liquid refrigerant. As a result, less or no bubble formation due to external heat input occurs in the first container 106, leading to a more stable supply or distribution of the refrigerant.

Figure 7:
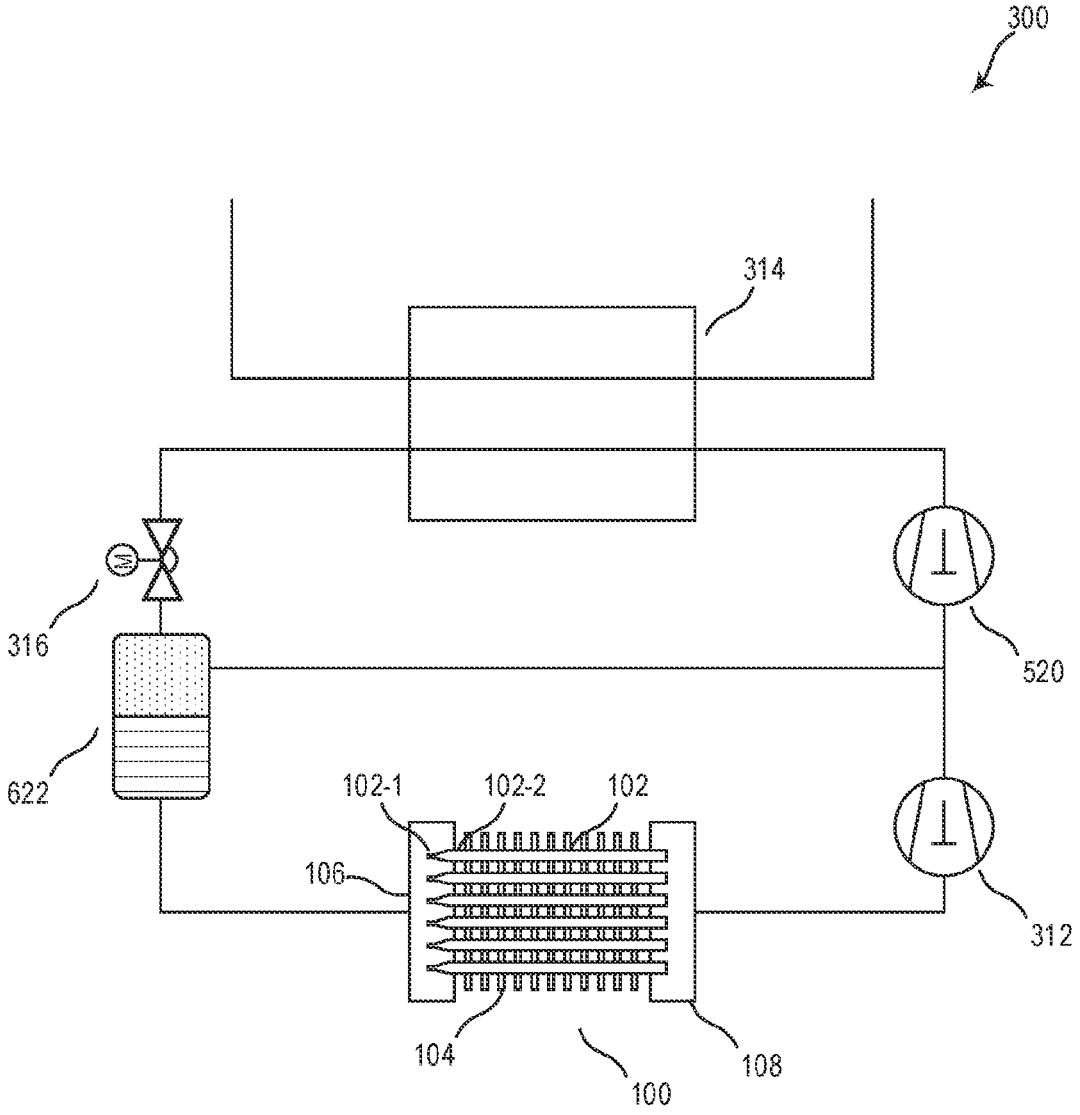
FIG. 7 shows a refrigeration system comprising a heat exchanger in a schematic representation according to various embodiments.

FIG. 7 illustrates a refrigeration system 300 comprising a heat exchanger 100 in a schematic view, according to various embodiments.

In this embodiment, the refrigeration system 300 may include the second compressor 520 and the separator 622, which may be configured as described above.

In this embodiment, the other valve 624 may be omitted, and the gaseous refrigerant discharged from the separator 622 (e.g., from the gas outlet of the separator 622) may be supplied to the second compressor 520. The two-stage compression allows that the pressure of the gaseous refrigerant discharged from the separator 622 (e.g., from the gas outlet of the separator 622) should not be reduced to a low pressure level.

According to various embodiments, the refrigeration system 300 may be configured such that the gaseous refrigerant output from the separator 622 (e.g., from the gas outlet of the separator 622) is supplied to the second compressor 520, for example, along with the compressed refrigerant output from the compressor 312.

According to various embodiments, the open-loop control system may be configured to open-loop control or the closed-loop control system may be configured to closed-loop control the second compressor 520 (e.g., a speed of the second compressor 520). For example, an increase in the speed of the second compressor 520 may result in a reduction in the pressure (e.g., the mean pressure) in the separator 622. In other words, the open-loop control system may be configured to open-loop control and/or the closed-loop control system may be configured to closed-loop control the second compressor 520 (e.g., the speed of the second compressor 520) such that the pressure of the refrigerant in the separator 622 may be increased (and/or decreased). Thus, the open-loop control or closed-loop control of the second compressor 520 may also be used to regulate the superheating of the refrigerant.

However, the refrigeration system 300 may additionally include the other valve 624 to provide another means of controlling the pressure in the separator 622.

According to various embodiments, the refrigeration system 300 may include another heat exchanger (not shown) that may be located downstream relative to the compressor 312, for example, between the gas outlet of the separator 622 and the outlet of the compressor 312. For example, the other heat exchanger may be located upstream relative to the second compressor 520. In this embodiment, the refrigeration system 300 may be configured such that the compressed refrigerant discharged from the compressor 312 may be cooled using the other heat exchanger. Such cooling allows a greater mass flow of refrigerant to flow into the second compressor 520, and may increase the efficiency of the compression process.

According to various embodiments, a cooling method for cooling a fluid by sublimation of a refrigerant may comprise providing a refrigerant to a heat exchanger 100. The heat exchanger 100 may be configured as described above, and may include at least one duct 102 for carrying refrigerant. The refrigerant provided to the heat exchanger 100 may be in a non-solid (e.g., liquid, gas, liquid gas, supercritical) state of matter.

According to various embodiments, the cooling method may comprise directing the refrigerant into the at least one duct 102 of the heat exchanger 100. The at least one duct 102 may include a first section 102-1 and a second section 102-2, the first section 102-1 being disposed upstream relative to the second section 102-2 with respect to a flow direction of the refrigerant in the at least one duct 102, the second section 102-2 comprising a cross-sectional area that is greater than a cross-sectional area of the first section 102-1 such that sublimation of the refrigerant in the second section 102-2 is enabled.

According to various embodiments, the cooling method may comprise directing the refrigerant into the first section 102-1 of the at least one duct 102 of the heat exchanger 100, wherein the cross-sectional area of the first section 102-1 may be sized to prevent sublimation of the refrigerant in the first section 102-1.

For example, the cross-sectional area of the first section 102-1 may be sized such that the refrigerant in the first section 102-1 is in a non-solid (e.g., liquid, gas, liquid/gas, supercritical, etc.) state of aggregation.

According to various embodiments, the cooling method may comprise directing the refrigerant into the second section 102-2 of the at least one duct 102 of the heat exchanger 100.

For example, the cross-sectional area of the second section 102-2 may be sized to expand the refrigerant in an at least partially solid (e.g., solid/gaseous) state of aggregation in the second section 102-2.

According to various embodiments, the cooling method may include providing heat transfer between the refrigerant flowing into the second section 102-2 and the fluid to be cooled such that the refrigerant flowing into the second section 102-2 may sublime and the fluid to be cooled may be cooled.

Further advantageous embodiments of the cooling method will be apparent from the description of the heat exchanger 100 and the refrigeration system 300, and vice versa.

The heat exchanger 100 described herein, the refrigeration system 300 described herein, and the cooling method described herein may be used in applications requiring deep cooling (e.g., at a temperature level below −50° C.).

One possible application is in the simulation of climatic conditions, for example for testing equipment and/or components at extremely low temperatures. Another possible application is in medical methods that require such a low temperature.

Various examples are described below which relate to what has been described and illustrated above.

Example 1 is a heat exchanger that may include at least one duct for carrying refrigerant, the at least one duct comprising a first section and a second section; the first section being disposed upstream relative to the second section with respect to a direction of flow of the refrigerant in the at least one duct; the second section comprising a cross-sectional area that is greater than a cross-sectional area of the first section so as to allow sublimation of the refrigerant in the second section.

In Example 2, the heat exchanger of Example 1 may optionally further comprise the at least one duct comprising a plurality of pipes (e.g., a plurality of mini-ducts, a plurality of mini-duct pipes, etc.).

In Example 3, the heat exchanger according to Example 1 or 2 may optionally further comprise the heat exchanger being configured such that a refrigerant flowing to the at least one duct may be in a heat transfer relationship with a fluid to be cooled.

In Example 4, the heat exchanger according to any one of Examples 1 to 3 may optionally further comprise the heat exchanger being configured such that a refrigerant flowing into the second section may be in a heat transfer relationship with a fluid to be cooled.

In Example 5, the heat exchanger according to any one of Examples 1 to 4 may optionally further comprise the second section being arranged directly adjacent to the first section.

In Example 6, the heat exchanger according to any one of Examples 1 to 5 may optionally further comprise the first section being configured to provide a restriction at the inlet of the at least one duct.

In Example 7, the heat exchanger according to any of Examples 1 to 6 may optionally further comprise that the cross-sectional area of the first section is dimensioned such that a drop in pressure of a refrigerant flowing into the first section occurs.

For example, the cross-sectional area of the first section may be sized such that a refrigerant is at a high pressure level (e.g., at a pressure level in a range from about 10 bars to about 160 bars, for example, in a range from about 70 bars to about 140 bars, for example, in a range from about 40 bars to about 70 bars) before the first section; in the first section, the refrigerant reaches a critical (sonic) velocity such that the pressure of the refrigerant in the first section falls to a lower pressure level (e.g. at a pressure level in a range of about 10 bars to about 70 bars, for example in a range of about 10 bars to about 40 bars, for example in a range of about 40 bars to about 70 bars); and after the first section (e.g. upon entering the second section), a further expansion of the refrigerant follows and the pressure of the refrigerant drops further (e.g. at a pressure level in a range of about 0 bars to about 5 bars, for example at a sublimation pressure level).

In Example 8, the heat exchanger according to any one of Examples 1 to 7 may optionally further comprise the cross-sectional area of the first section being sized to prevent sublimation of the refrigerant in the first section.

In Example 9, the heat exchanger according to any of Examples 1 to 8 may optionally further comprise that the cross-sectional area of the first section is dimensioned such that the refrigerant in the first section is or may be in a non-solid (e.g., liquid, gas, liquid/gas, supercritical, etc.) state of aggregation.

In Example 10, the heat exchanger according to any one of Examples 1 to 9 may optionally further comprise that the cross-sectional area of the first section is dimensioned such that the refrigerant is at a pressure level in the first section (e.g., up to the outlet of the first section) that is greater than the pressure level of the triple point of the refrigerant.

In Example 11, the heat exchanger according to any one of Examples 1 to 10 may optionally further comprise that the cross-sectional area of the first section is dimensioned such that the critical mass flow rate through the first section dependent on the pressure at the inlet of the first section is achieved.

In Example 12, the heat exchanger of any one of Examples 1 to 11 may optionally further comprise the cross-sectional area of the first section and the cross-sectional area of the second section being dimensioned such that a refrigerant flowing into the at least one duct is at such a pressure level (e.g., atmospheric pressure level) downstream relative to the first section (e.g., in the second section) as to allow sublimation of the refrigerant.

In Example 13, the heat exchanger according to any one of Examples 1 to 12 may optionally further comprise that the cross-sectional area of the first section and the cross-sectional area of the second section are dimensioned such that the refrigerant is expanded into an at least partially solid (e.g., solid/gaseous) state of aggregation in the second section.

In Example 14, the heat exchanger according to any of Examples 1 to 13 may optionally further comprise the first section having a cross-sectional area in a range from about 0.0001 $mm^2$ to about 0.8 $mm^2$, for example in a range from about 0.001 $mm^2$ to about 0.5 $mm^2$, for example in a range from about 0.005 $mm^2$ to about 0.25 $mm^2$.

In Example 15, the heat exchanger of any of Examples 1 to 14 may optionally further comprise the second section having a cross-sectional area in a range from about 0.01 $mm^2$ to about 400 $mm^2$, for example in a range from about 0.1 $mm^2$ to about 100 $mm^2$, for example in a range from about 0.5 $mm^2$ to about 50 $mm^2$, for example in a range from about 1 $mm^2$ to about 20 $mm^2$.

In Example 16, the heat exchanger according to any one of Examples 1 to 15 may optionally further comprise the cross-sectional area of the first section and the cross-sectional area of the second section being dimensioned such that the refrigerant is at a pressure level in a range of about 0 bars to about 5 bars in the second section.

In Example 17, the heat exchanger according to any of Examples 1 to 16 may optionally further comprise that the refrigerant comprises carbon dioxide.

In Example 18, the heat exchanger according to any of Examples 1 to 17 may optionally further comprise the refrigerant comprising a hydrocarbon-based refrigerant.

For example, the refrigerant may comprise HFC and/or HCFC and/or HFO and/or R170 and/or R290 and/or R600, etc.

In Example 19, the heat exchanger according to any one of Examples 1 to 18 may optionally further comprise the refrigerant comprising a mixture of a plurality of refrigerants different from each other.

In Example 20, the heat exchanger according to any one of Examples 1 to 19 may optionally further comprise a first container (e.g., a distribution container) configured to supply the refrigerant to the at least one duct.

For example, the first container may be configured to distribute (e.g., evenly) the refrigerant to the plurality of pipes (e.g., to the plurality of mini-ducts) of the at least one duct.

In Example 21, the heat exchanger of Example 20 may optionally further comprise the first vessel being configured such that a refrigerant flowing into the first vessel is at a pressure level that is above a pressure level of the triple point of the refrigerant.

In Example 22, the heat exchanger according to Example 20 or 21 may optionally further comprise the first container being configured such that the refrigerant is at a medium pressure level or high pressure level (e.g., at a pressure level in a range from about 10 bars to about 160 bars, for example, in a range from about 70 bars to about 140 bars, for example, in a range from about 40 bars to about 70 bars, for example, in a range from about 10 bars to about 40 bars, etc.) in the first container.

In Example 23, the heat exchanger according to any of Examples 20 to 22 may optionally further comprise the first container being configured such that a refrigerant flowing into the first container is in a non-solid (e.g., liquid, gas, liquid/gas, supercritical, etc.) state of aggregation.

In Example 24, the heat exchanger according to any one of Examples 20 to 23 may optionally further comprise the first vessel being configured as a separator (e.g., a medium pressure separator).

For example, the first container may be configured to supply the liquid refrigerant to the at least one duct and to discharge the gaseous refrigerant from a gas outlet.

In Example 25, the heat exchanger according to any of Examples 1 to 24 may optionally further comprise a second container a collection container) configured to receive the refrigerant discharged from the at least one duct.

In Example 26, the heat exchanger of Example 25 may optionally further comprise the second vessel being configured as a solids separator (e.g., a cyclonic separator).

For example, the second container may be configured to dispense gaseous refrigerant from a first outlet and to accumulate solid refrigerant (e.g., solid refrigerant components, such as solid particles of refrigerant).

In Example 27, the heat exchanger according to any one of Examples 1 to 26 may optionally further comprise the first section having a circular cross-section or an elliptical cross-section.

In Example 28, the heat exchanger according to any of Examples 1 to 26 may optionally further comprise the first section having a square cross-section, or a rectangular cross-section, or a polygonal cross-section.

In Example 29, the heat exchanger according to any one of Examples 1 to 28 may optionally further comprise the cross-section of the first section having a size along a direction perpendicular to the direction of flow of the refrigerant in the at least one duct (e.g., a height, a width, a diameter, an edge length, etc.) in a range from about 0.01 mm to about 0.5 mm, for example in a range from about 0.01 mm to about 0.2 mm, for example in a range from about 0.02 mm to about 0.1 mm, for example in a range from about 0.02 mm to about 0.05 mm.

For example, the size of the cross-section of the first section may be less than 0.1 mm.

In Example 30, the heat exchanger according to any one of Examples 1 to 29 may optionally further comprise the second section having a circular or elliptical cross-section.

In Example 31, the heat exchanger according to any of Examples 1 to 29 may optionally further comprise the second section having a square cross-section, or a rectangular cross-section, or a polygonal cross-section.

In Example 32, the heat exchanger according to any one of Examples 1 to 31 may optionally further comprise the cross-section of the second section having a size along a direction perpendicular to the direction of flow of the refrigerant in the at least one duct (e.g., a height, a width, a diameter, an edge length, etc.) in a range from about 0.1 mm to about 20 mm, for example from about 0.5 mm to about 10 mm, from about 1 mm to about 5 mm.

In Example 33, the heat exchanger according to any of Examples 1 to 32 may optionally further comprise providing (in other words, reducing) the cross-sectional area of the first section using compressing the at least one duct.

In Example 34, the heat exchanger according to any one of Examples 1 to 33 may optionally further comprise the at least one duct comprising a narrowing element (e.g., a sleeve, a perforated disc, a perforated plate, a cap, etc.) disposed in the first section such that the cross-sectional area of the first section is reduced.

In Example 35, the heat exchanger according to any of Examples 1 to 33 may optionally further comprise a narrowing element disposed (e.g., attached, such as soldered, etc.) at the inlet of the at least one duct.

For example, the narrowing member may serve as a first section of the at least one duct, and the at least one duct may serve as a second section of the at least one duct.

Example 36 is a heat exchanger comprising at least one duct for carrying refrigerant, and at least one narrowing element disposed upstream relative to the at least one duct, wherein the at least one duct has a cross-sectional area that is greater than a cross-sectional area (e.g., an internal cross-sectional area) of the at least one narrowing element such that sublimation of the refrigerant in the at least one duct is enabled.

In Example 37, the heat exchanger of Example 36 may optionally further comprise the at least one narrowing element disposed (e.g., attached, such as soldered, etc.) at the inlet of the at least one duct.

Example 38 is a refrigeration system comprising a heat exchanger according to any of Examples 1 to 37.

The refrigeration system may optionally comprise an open-loop control system or a closed-loop control system. The open-loop control system may be configured to open-loop control the components of the refrigeration system or the closed-loop control system may be configured to closed-loop control the operating conditions of the components of the refrigeration system.

The refrigeration system may optionally comprise a compressor arranged downstream relative to the heat exchanger.

The refrigeration system may optionally include a heat-dissipating heat exchanger. For example, the heat-dissipating heat exchanger may be located downstream relative to the compressor. For example, the heat-dissipating heat exchanger may be disposed upstream relative to the heat exchanger (e.g., relative to the first vessel of the heat exchanger).

In Example 39, the refrigeration system according to example 38 may optionally further comprise the open-loop control system being configured to open-loop control or the closed-loop control system being configured to closed-loop control the compressor the speed of the compressor) such that the pressure of the refrigerant (e.g. in the heat exchanger) may be increased (or decreased).

In Example 40, the refrigeration system according to example 38 or 39 may optionally further comprise that the open-loop control system or the closed-loop control system is configured to control the heat emitting heat exchanger such that the pressure of the refrigerant emitted from the heat emitting heat exchanger is increased (or decreased) such that the mass flow rate of the refrigerant in the first container is increased (or decreased).

In Example 41, the refrigeration system according to any one of examples 38 to 40 may optionally further comprise that the open-loop control system or the closed-loop control system is configured to control (open-loop or closed-loop, respectively) the heat emitting heat exchanger such that the pressure of the refrigerant emitted from the heat emitting heat exchanger is increased (or decreased) so that superheating of the refrigerant is reduced (or increased).

In Example 42, the refrigeration system according to any of Examples 38 to 41 may optionally include a valve (e.g., a throttle valve, a capillary pipe, an expansion valve such as a thermostatic expansion valve, an electronic expansion valve, a manual expansion valve, etc.). The valve may be configured to reduce the pressure of the refrigerant as it flows into the valve.

For example, the valve may be positioned downstream relative to the heat-emitting heat exchanger and upstream relative to the heat exchanger (e.g., between the heat-emitting heat exchanger and the heat exchanger).

In Example 43, the refrigeration system according to example 42 may optionally further comprise that the open-loop control system is configured to open-loop control the valve, or the closed-loop control system is configured to closed-loop control the valve, such that the pressure of the refrigerant discharged from the valve is increased (or decreased) such that the mass flow rate of the refrigerant in the heat exchanger (e.g. in the first container) is increased (or decreased).

In Example 44, the refrigeration system according to any one of examples 38 to 43 may optionally further comprise the first container of the heat exchanger being configured as a separator (e.g. a medium pressure separator), and the refrigeration system being configured for the gaseous refrigerant discharged from the first container to be supplied to the compressor.

In Example 45, the refrigeration system according to example 44 may optionally further comprise an additional valve (e.g., a throttle valve, a capillary pipe, an expansion valve such as a thermostatic expansion valve, an electronic expansion valve, a manual expansion valve, etc.). The additional valve may be configured to reduce the pressure of the refrigerant as it flows into the additional valve.

For example, the additional valve may be located downstream relative to a gas outlet of the first container (e.g., between the gas outlet of the first container and the compressor).

In Example 46, the refrigeration system according to any of examples 38 to 45 may optionally further comprise the second container of the heat exchanger being configured as a solids separator. For example, superheating of the refrigerant may be detected at the bottom of the second container.

In Example 47, the refrigeration system according to any of Examples 38 to 46 may optionally further comprise a second compressor (e.g., a reciprocating compressor, a screw compressor, a rotary compressor, a centrifugal compressor, a scroll compressor, etc.). For example, the second compressor may be located downstream relative to the compressor.

For example, the refrigeration system may be configured such that the gaseous refrigerant discharged from the first container (e.g., from the gas outlet of the first container) is supplied to the second compressor together with the compressed refrigerant discharged from the compressor.

In Example 48, the refrigeration system according to example 47 may optionally further comprise the open-loop control system being configured to open-loop control or the closed-loop control system being configured to closed-loop control the second compressor (e.g., a speed of the additional compressor) such that the pressure of the refrigerant in the first vessel is increased (or decreased).

In Example 49, the refrigeration system according to any of examples 38 to 48 may optionally further comprise a separator (e.g., a medium pressure separator). The separator may be configured to separate gaseous refrigerant from liquid refrigerant. The separator may be arranged upstream relative to the heat exchanger. For example, the refrigeration system may be configured such that the gaseous refrigerant discharged from the separator is supplied to the compressor and/or the second compressor.

In Example 50, the refrigeration system according to example 49 may optionally further comprise another valve (e.g., a throttle valve, a capillary pipe, an expansion valve such as a thermostatic expansion valve, an electronic expansion valve, a manual expansion valve, etc.). The other valve may be configured to reduce the pressure of the refrigerant as it flows into the other valve. The other valve may be arranged downstream relative to a gas outlet of the separator.

In Example 51, the refrigeration system according to Example 50 may optionally further comprise the open-loop control system being configured to open-loop control or the closed-loop control system being configured to closed-loop control the other valve such that the pressure of the refrigerant discharged from the other valve is increased (or decreased) such that the pressure of the refrigerant in the separator is increased (or decreased).

In Example 52, the refrigeration system according to example 50 or 51 may optionally further comprise that the open-loop control system is configured to open-loop control the other valve or the closed-loop control system is configured to closed-loop control the other value such that the pressure of the refrigerant discharged from the other valve is increased (or decreased) so that the mass flow rate of the refrigerant in the separator is increased (or decreased).

In Example 53, the refrigeration system according to any of examples 50 to 52 may optionally further comprise the open-loop control system being configured to open-loop control the other valve or the closed-loop control system being configured to closed-loop control the other value such that the pressure (e.g. the intermediate pressure) in the separator is increased to supercritical pressure below or equal to the high pressure (e.g. at a pressure level in a range from about 10 bars to about 160 bars, for example from about 70 bars to about 140 bars, for example from about 40 bars to about 70 bars).

In Example 54, the refrigeration system according to example 47 or 48 and according to any one of examples 49 to 53 may optionally further comprise that the open-loop control system is configured to open-loop control or the closed-loop control system is configured to closed-loop control the second compressor (e.g. the speed of the second compressor) such that the pressure of the refrigerant in the separator is increased (or decreased).

Example 55 is a cooling method for cooling a fluid using sublimation of a refrigerant, comprising the following: providing a refrigerant to a heat exchanger, the heat exchanger comprising at least one duct for carrying refrigerant; carrying the refrigerant into the at least one duct, the at least one duct comprising a first section and a second section, the first section being located upstream relative to the second section with respect to a direction of flow of the refrigerant in the at least one duct, the second section comprising a cross-sectional area that is greater than a cross-sectional area of the first section so as to allow sublimation of the refrigerant in the second section; providing heat transfer between the refrigerant flowing into the second section and the fluid to be cooled so that the refrigerant flowing into the second section can be sublimated and the fluid to be cooled.

In Example 56, the cooling method of Example 55 may optionally further comprise the refrigerant provided to the heat exchanger being in a non-solid (e.g., liquid, gas, liquid/gas, supercritical, etc.) state of matter.

In Example 57, the cooling method of example 55 or 56 may optionally further comprise directing the refrigerant into a first section of the at least one duct of the heat exchanger, wherein the cross-sectional area of the first section is sized to prevent sublimation of the refrigerant in the first section.

In Example 58, the cooling method of any one of examples 55 to 57 may optionally further comprise directing the refrigerant into a second section of the at least one duct of the heat exchanger.

In Example 59, the cooling method according to any one of examples 55 to 58 may optionally further comprise the at least one duct comprising a plurality of pipes (e.g., a plurality of mini-ducts, a plurality of mini-duct pipes).

In Example 60, the cooling method according to any one of examples 55 to 59 may optionally further comprise the heat exchanger being configured such that a refrigerant flowing into the at least one duct may be in a heat transfer relationship with a fluid to be cooled.

In Example 61, the cooling method according to any one of examples 55 to 60 may optionally further comprise the heat exchanger being configured such that a refrigerant flowing into the second section may be in a heat transfer relationship with a fluid to be cooled.

In Example 62, the cooling method according to any one of examples 55 to 61 may optionally further comprise the second section being directly adjacent to the first section.

In Example 63, the cooling method according to any one of examples 55 to 62 may optionally further comprise the first section being configured to provide a restriction at the inlet of the at least one duct.

In Example 64, the cooling method according to any one of examples 55 to 63 may optionally further comprise dimensioning the cross-sectional area of the first section such that a drop in pressure of a refrigerant flowing into the first section occurs.

For example, the cross-sectional area of the first section may be dimensioned such that a refrigerant is at a high pressure level (e.g., at a pressure level in a range from about 10 bars to about 160 bars, for example, in a range from about 70 bars to about 140 bars, for example, in a range from about 40 bars to about 70 bars) before the first section; in the first section, the refrigerant reaches a critical (sonic) velocity such that the pressure of the refrigerant in the first section falls to a lower pressure level (e.g. at a pressure level in a range of about 10 bars to about 70 bars, for example in a range of about 10 bars to about 40 bars, for example in a range of about 40 bars to about 70 bars); and after said first section (e.g. upon entering said second section) further expansion of said refrigerant follows and the pressure of said refrigerant drops further (e.g. at a pressure level in a range of about 0 bars to about 5 bars, for example at a sublimation pressure level).

In Example 65, the cooling method according to any one of examples 55 to 64 may optionally further comprise dimensioning the cross-sectional area of the first section such that sublimation of the refrigerant in the first section is prevented.

In Example 66, the cooling method of any of examples 55 to 65 may optionally further comprise dimensioning the cross-sectional area of the first section such that the refrigerant in the first section is or may be in a non-solid (e.g., liquid, gas, liquid/gas, supercritical, etc.) state of aggregation.

In Example 67, the cooling method according to any of examples 55 to 66 may optionally further comprise dimensioning the cross-sectional area of the first section such that the refrigerant is at a pressure level in the first section (e.g., until exiting the first section) that is greater than the pressure level of the triple point of the refrigerant.

In Example 68, the cooling method according to any of examples 55 to 67 may optionally further comprise dimensioning the cross-sectional area of the first section such that the critical mass flow rate through the first section dependent on the pressure at the inlet of the first section is achieved.

In Example 69, the cooling method of any of examples 55 to 68 may optionally further comprise dimensioning the cross-sectional area of the first section and the cross-sectional area of the second section such that a refrigerant flowing into the at least one duct is at such a pressure level (e.g., atmospheric pressure level) downstream relative to the first section (e.g., in the second section) as to allow sublimation of the refrigerant.

In Example 70, the cooling method according to any of examples 55 to 69 may optionally further comprise dimensioning the cross-sectional area of the first section and the cross-sectional area of the second section such that the refrigerant is expanded into an at least partially solid (e.g., solid/gaseous) state of aggregation in the second section.

In Example 71, the cooling method of any of Examples 55 to 70 may optionally further comprise the first section having a cross-sectional area in a range from about 0.0001 $mm^2$ to about 0.8 $mm^2$, for example in a range from about 0.001 $mm^2$ to about 0.5 $mm^2$, for example in a range from about 0.005 $mm^2$ to about 0.25 $mm^2$.

In Example 72, the cooling method of any of examples 55 to 71 may optionally further comprise the second section having a cross-sectional area in a range from about 0.01 $mm^2$ to about 400 $mm^2$, for example in a range from about 0.1 $mm^2$ to about 100 $mm^2$, for example in a range from about 0.5 $mm^2$ to about 50 $mm^2$, for example in a range from about 1 $mm^2$ to about 20 $mm^2$.

In Example 73, the cooling method of any of Examples 55 to 72 may optionally further comprise dimensioning the cross-sectional area of the first section and the cross-sectional area of the second section such that the refrigerant is at a pressure level in a range of about 0 bars to about 5 bars in the second section.

In Example 74, the cooling method according to any one of Examples 55 to 73 may optionally further comprise the refrigerant comprising carbon dioxide.

In Example 75, the cooling method according to any one of Examples 55 to 74 may optionally further comprise the refrigerant comprising a hydrocarbon-based refrigerant.

For example, the refrigerant may comprise HFC and/or HCFC and/or HFO and/or R170 and/or R290 and/or R600, etc.

In Example 76, the cooling method according to any one of examples 55 to 75 may optionally further comprise the refrigerant comprising a mixture of a plurality of refrigerants different from each other.

In Example 77, the cooling method according to any one of examples 55 to 76 may optionally further comprise a first container a distribution container) configured to supply the refrigerant to the at least one duct.

For example, the first container may be configured to distribute the refrigerant (e.g., evenly) among the plurality of pipes (e.g., the plurality of mini-ducts) of the at least one duct if the at least one duct includes a plurality of pipes.

In Example 78, the cooling method of example 77 may optionally further comprise the first container being configured such that a refrigerant flowing into the first container is at a pressure level that is above the pressure level of the triple point of the refrigerant.

In Example 79, the cooling method according to example 77 or 78 may optionally further comprise the first container being configured such that the refrigerant is at a medium pressure level or high pressure level (e.g., at a pressure level in a range from about 10 bars to about 160 bars, for example, in a range from about 70 bars to about 140 bars, for example, in a range from about 40 bars to about 70 bars, for example, in a range from about 10 bars to about 40 bars, etc.) in the first container.

In Example 80, the cooling method according to any of examples 77 to 79 may optionally further comprise the first container being configured such that a refrigerant flowing into the first container is in a non-solid (e.g., liquid, gas, liquid/gas, supercritical, etc.) state of aggregation.

In Example 81, the cooling method according to any one of examples 77 to 80 may optionally further comprise setting up the first vessel as a separator (e.g., a medium pressure separator).

For example, the first container may be configured to supply the liquid refrigerant to the at least one duct and to discharge the gaseous refrigerant from a gas outlet.

In Example 82, the cooling method according to any of examples 55 to 81 may optionally further comprise a second container (e.g., a collection container) configured to receive the refrigerant dispensed from the at least one duct.

In Example 83, the cooling method of example 82 may optionally further comprise the second vessel being configured as a solids separator (e.g., a cyclonic separator).

For example, the second container may be configured to dispense gaseous refrigerant from a first outlet and to accumulate solid refrigerant (e.g., solid refrigerant components, such as solid particles of refrigerant).

In Example 84, the cooling method according to any one of examples 55 to 83 may optionally further comprise the first section having a circular cross-section or an elliptical cross-section.

In Example 85, the cooling method according to any one of examples 55 to 83 may optionally further comprise the first section having a square cross-section, or a rectangular cross-section, or a polygonal cross-section.

In Example 86, the cooling method according to any one of examples 55 to 85 may optionally further comprise the cross-section of the first section having a dimension along a direction perpendicular to the flow direction of the refrigerant in the at least one duct (e.g., a height, a width, a diameter, an edge length, etc.) in a range from about 0.01 mm to about 0.5 mm, for example in a range from about 0.01 mm to about 0.2 mm, for example in a range from about 0.02 mm to about 0.1 mm, for example in a range from about 0.02 mm to about 0.05 mm.

For example, the size of the cross-section of the first section may be less than 0.1 mm.

In Example 87, the cooling method according to any one of examples 55 to 86 may optionally further comprise the second section having a circular or elliptical cross-section.

In Example 88, the cooling method according to any one of examples 55 to 86 may optionally further comprise the second section having a square cross-section, or a rectangular cross-section, or a polygonal cross-section.

In Example 89, the cooling method according to any one of Examples 55 to 88 may optionally further comprise the cross-section of the second section having a size along a direction perpendicular to the direction of flow of the refrigerant in the at least one duct (e.g., a height, a width, a diameter, an edge length, etc.) in a range from about 0.1 mm to about 20 mm, for example, from about 0.5 mm to about 10 mm, from about 1 mm to about 5 mm.

In Example 90, the cooling method according to any of examples 55 to 89 may optionally further comprise providing (in other words, reducing) the cross-sectional area of the first section by compressing the at least one duct.

In Example 91, the cooling method according to any one of examples 55 to 90 may optionally further comprise the at least one duct comprising a narrowing element (e.g., a sleeve, a perforated disc, a perforated plate, a cap, etc.) disposed in the first section such that the cross-sectional area of the first section is reduced.

In Example 92, the cooling method according to any one of examples 55 to 90 may optionally further comprise disposing (e.g., attaching, such as soldering, etc.) a narrowing element at the inlet of the at least one duct.

For example, the narrowing member may serve as a first section of the at least one duct, and the at least one duct may serve as a second section of the at least one duct.

The invention claimed is:

1. A heat exchanger comprising at least one duct for carrying refrigerant, the at least one duct comprising a first section and a second section;

wherein the first section is disposed upstream relative to the second section with respect to a direction of flow of the refrigerant in the at least one duct;

wherein the second section has a cross-sectional area that is larger than a cross-sectional area of the first section so as to allow sublimation of the refrigerant in the second section; wherein the at least one duct comprises a narrowing member disposed in the first section such that the cross-sectional area of the first section is reduced.

2. The heat exchanger according to claim 1, wherein the cross-sectional area of the first section is dimensioned to prevent sublimation of the refrigerant in the first section.

3. The heat exchanger according to claim 1, wherein the cross-sectional area of the first section is dimensioned such that the refrigerant is at a pressure level in the first section that is greater than a pressure level of a triple point of the refrigerant.

4. The heat exchanger according to claim 1, wherein the cross-sectional area of the first section and the cross-sectional area of the second section are dimensioned such that the refrigerant is expanded into an at least partially solid aggregate state in the second section.

5. The heat exchanger according to claim 1, wherein the refrigerant comprises carbon dioxide.

6. The heat exchanger according to claim 1, wherein the first section has a cross-sectional area in a range from about 0.0001 $mm^2$ to about 0.8 $mm^2$.

7. The heat exchanger according to claim 1, wherein the second section has a cross-sectional area in a range from about 0.01 $mm^2$ to about 400 $mm^2$.

8. The heat exchanger according to claim 1, wherein the cross-sectional area of the first section and the cross-sectional area of the second section are dimensioned such that sublimation of the refrigerant flowing into the at least one duct is prevented in the first section and that sublimation of the refrigerant is enabled as a result of a pressure drop of the refrigerant during the transition from the first section to the second section.

9. A refrigeration system comprising the heat exchanger according to claim 1.

10. A cooling method for cooling a fluid by sublimation of a refrigerant comprising the following:

Providing a refrigerant to a heat exchanger, the heat exchanger comprising at least one duct for carrying refrigerant;

Guiding the refrigerant into the at least one duct, wherein the at least one duct comprises a first section and a second section;

wherein the first section is disposed upstream relative to the second section with respect to a direction of flow of the refrigerant in the at least one duct;

wherein the second section has a cross-sectional area that is larger than a cross-sectional area of the first section o as to allow sublimation of the refrigerant in the second section; and wherein the at least one duct comprises a narrowing member disposed in the first section such that the cross-sectional area of the first section is reduced; and providing heat transfer between the refrigerant flowing into the second section and the fluid to be cooled, such that the refrigerant flowing in the second section is sublimated and the fluid to be cooled is cooled.

11. A heat exchanger comprising at least one duct for carrying refrigerant, wherein the at least one duct comprises a first section, a second section, and a narrowing member disposed in the first section such that the cross-sectional area of the first section is reduced;

wherein the first section is disposed upstream relative to the second section with respect to a direction of flow of a refrigerant in the at least one duct, wherein the first section is configured such that the refrigerant flowing into the first section is at a pressure level which is above a pressure level of a triple point of the refrigerant, and wherein the second section is configured such that a refrigerant flowing into the second section is at a pressure level which is below the pressure level of the triple point of the refrigerant.

12. The heat exchanger of claim 1, wherein a cross-sectional area of the first section is dimensioned to prevent sublimation of the refrigerant in the first section, wherein the cross-sectional area of the first section is dimensioned such that the refrigerant is at a pressure level in the first section that is greater than a pressure level of a triple point of the refrigerant, and wherein the cross-sectional area of the first section and the cross-sectional area of the second section are dimensioned such that the refrigerant is expanded into an at least partially solid aggregate state in the second section.

* * * * *